US011708231B2

(12) United States Patent
Yoshimura et al.

(10) Patent No.: US 11,708,231 B2
(45) Date of Patent: Jul. 25, 2023

(54) PAPER SHEET SENSING DEVICE, PAPER SHEET CONVEYING DEVICE, AND IMAGE FORMING APPARATUS

(71) Applicant: Konica Minolta, Inc., Tokyo (JP)

(72) Inventors: Kazutoshi Yoshimura, Hino (JP); Satoshi Ogata, Hachioji (JP); Masayuki Watanabe, Fuchu (JP); Hidenori Mine, Tachikawa (JP)

(73) Assignee: Konica Minolta, Inc., Tokyo (JP)

( * ) Notice: Subject to any disclaimer, the term of this patent is extended or adjusted under 35 U.S.C. 154(b) by 172 days.

(21) Appl. No.: 17/242,191

(22) Filed: Apr. 27, 2021

(65) Prior Publication Data

US 2021/0354941 A1 Nov. 18, 2021

(30) Foreign Application Priority Data

May 18, 2020 (JP) ..... 2020-086971

(51) Int. Cl.
*B65H 7/02* (2006.01)
*B65H 5/06* (2006.01)
*B65H 7/20* (2006.01)

(52) U.S. Cl.
CPC ..... *B65H 7/02* (2013.01); *B65H 5/062* (2013.01); *B65H 7/20* (2013.01); *B65H 2511/13* (2013.01)

(58) Field of Classification Search
CPC ..... B65H 7/02; B65H 7/20; B65H 2511/13; B65H 2511/22; B65H 2511/224; B65H 5/062; B65H 2553/61; B65H 2515/84; B65H 2404/142; B65H 2404/144; G03G 2215/00738; G01B 21/08
See application file for complete search history.

(56) References Cited

U.S. PATENT DOCUMENTS 9,718,634 B2 * 8/2017 Kambayashi ..... B65H 5/062
2012/0137533 A1 * 6/2012 Muranaka ..... G07D 7/164 33/833
2014/0015192 A1 * 1/2014 Wakabayashi ..... B65H 7/20 271/265.04

FOREIGN PATENT DOCUMENTS

JP 2015-013719 A 1/2015

* cited by examiner

*Primary Examiner* — Luis A Gonzalez
(74) *Attorney, Agent, or Firm* — Squire Patton Boggs (US) LLP

(57) ABSTRACT

A paper sheet sensing device includes: a sheet thickness sensor that includes a reference member and a displacement sensor, and senses a sheet thickness of a conveyed recording medium by bringing the reference member into contact with the recording medium and sensing a position of a height of the reference member with the displacement sensor, the position of the height having changed with the recording medium; a first attacher to which the sheet thickness sensor is attached; a conveyor that nips and conveys the recording medium, and is disposed adjacent to the sheet thickness sensor at a predetermined distance equal to or shorter than a length of the recording medium being conveyed, in a conveyance direction of the recording medium; and a displacement preventer that prevents a change in an output of the displacement sensor due to a shift of a relative position of the height of the reference member.

9 Claims, 17 Drawing Sheets

PAPER SHEET SENSING DEVICE, PAPER SHEET CONVEYING DEVICE, AND IMAGE FORMING APPARATUS

The entire disclosure of Japanese patent Application No. 2020-086971, filed on May 18, 2020, is incorporated herein by reference in its entirety.

BACKGROUND

Technological Field

The present invention relates to a paper sheet sensing device, a paper sheet conveying device, and an image forming apparatus.

Description of the Related Art

Image forming apparatuses such as electrophotographic printers are being widely used in the color printing industry these days. In the field of production print (PP), which is compatible with the color printing industry, it is necessary to adapt to various kinds of paper sheets compared to those used in offices. To perform high-quality printing on these various kinds of paper sheets, there is an image forming apparatus that sets the characteristics of the paper sheets stored in the sheet feed trays in terms of multiple items, and performs printing under image forming conditions suitable for the set items.

There is a sheet material thickness detecting device that automatically detects the thickness of a paper sheet as the characteristics of the paper sheets to be used for printing, to perform the above settings for various kinds of paper sheets. For example, in a sheet material thickness detecting device disclosed in JP 2015-13719 A, a driven roller is supported in a displaceable manner with respect to a driving roller, and a displacement amount of a first driven roller shaft that supports two driven rollers in the thickness direction of a paper sheet is sensed with a displacement sensor, so that the thickness of the paper sheet is detected.

However, JP 2015-13719 A focuses only on the dimensional tolerance of the roller diameter, and does not taken into consideration the influence of the rollers disposed on the upstream side or the downstream side of a sheet thickness sensor.

SUMMARY

The present invention has been made in view of the above circumstances, and an object thereof is to provide a paper sheet sensing device that prevents a decrease in sheet thickness sensing accuracy due to the influence of a conveyor located on the upstream side or the downstream side and is capable of sensing sheet thickness with high accuracy, a paper sheet conveying device including the paper sheet sensing device, and an image forming apparatus.

To achieve the abovementioned object, according to an aspect of the present invention, a paper sheet sensing device reflecting one aspect of the present invention comprises: a sheet thickness sensor that includes a reference member and a displacement sensor, and senses a sheet thickness of a conveyed recording medium by bringing the reference member into contact with the recording medium and sensing a position of a height of the reference member with the displacement sensor, the position of the height having changed with the recording medium; a first attacher to which the sheet thickness sensor is attached; a conveyor that nips and conveys the recording medium, and is disposed adjacent to the sheet thickness sensor at a predetermined distance equal to or shorter than a length of the recording medium being conveyed, in a conveyance direction of the recording medium; and a displacement preventer that prevents a change in an output of the displacement sensor due to a shift of a relative position of the height of the reference member, depending on whether there is the recording medium nipped by the conveyor, when the sheet thickness sensor senses the sheet thickness.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
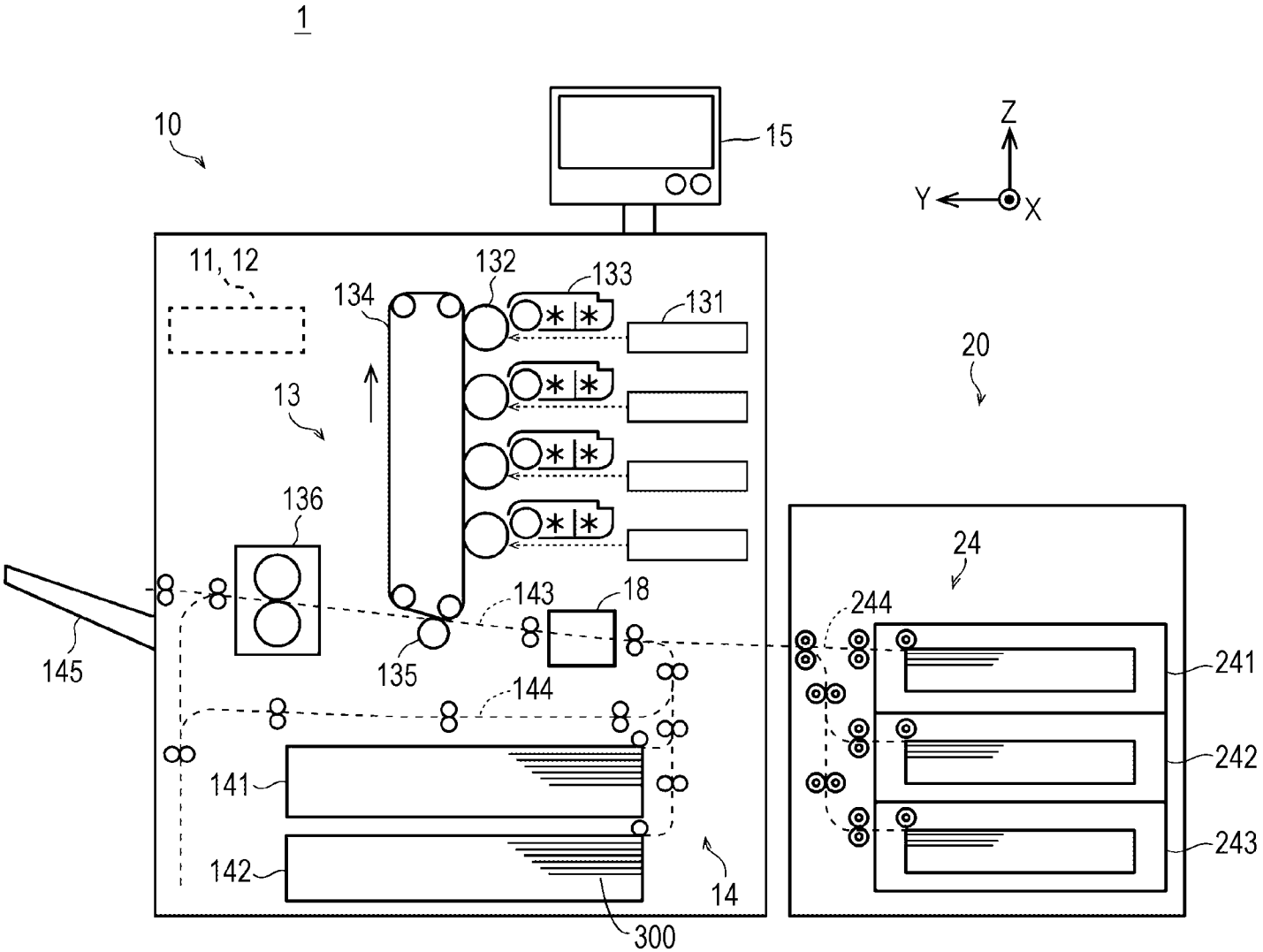
FIG. 1 is a diagram schematically showing the configuration of an image forming apparatus including a paper sheet sensing device according to an embodiment.
Figure 2:
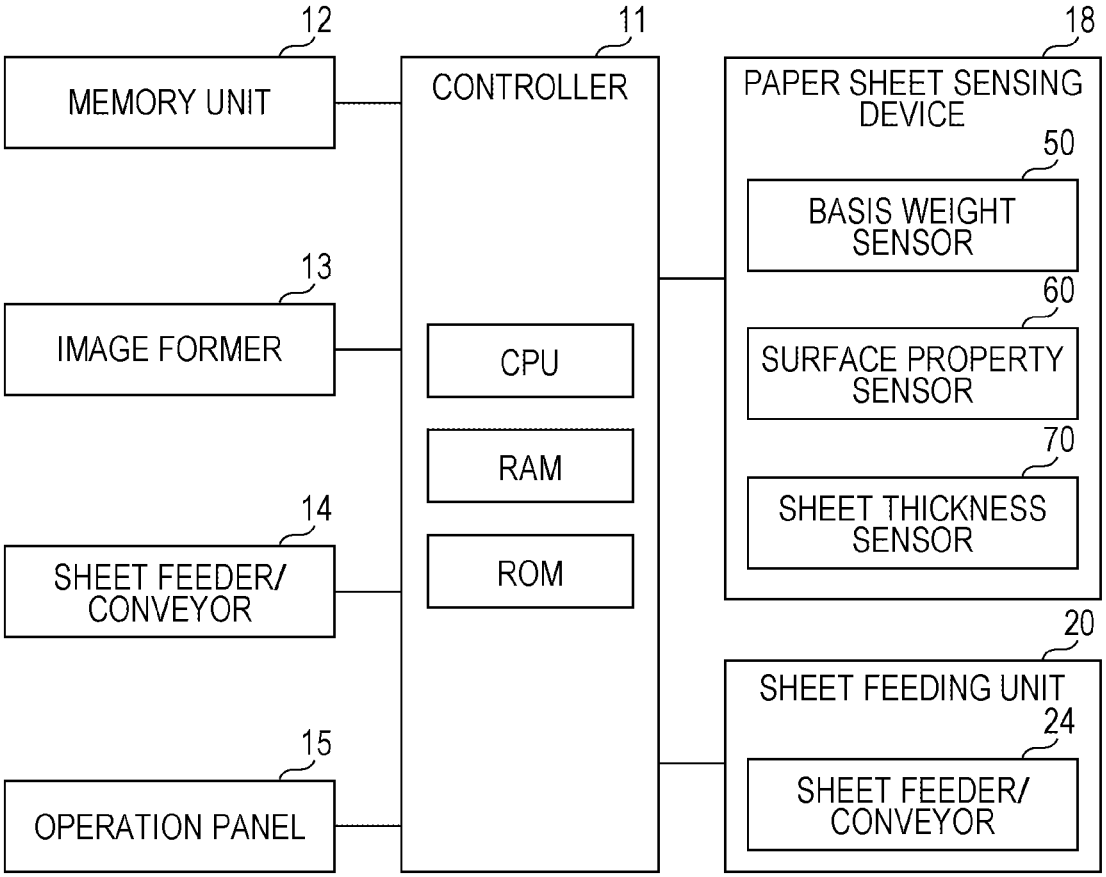
FIG. 2 is a block diagram showing the configuration of the image forming apparatus.

Hereinafter, one or more embodiments of the present invention will be described with reference to the drawings. However, the scope of the invention is not limited to the disclosed embodiments. In the description below with reference to the drawings, like components are denoted by like reference numerals, and explanation of those components will not be repeated twice or more. The dimensional ratios in the drawings are increased for ease of explanation, and may differ from the actual dimensional ratios. In the drawings, the vertical direction is the Z direction, the frontward/rearward direction of the image forming apparatus is the X direction, and the direction orthogonal to the X and Z directions is the Y direction. The X direction is also referred to as the width direction or the rotation axis direction. In the vicinity of a paper sheet sensing device (the paper sheet sensing device 18 described later), the Y' direction is the recording medium conveyance direction that is parallel to the plane of a conveyance path (the conveyance path 143 described later) inclined with respect to the horizontal plane and is orthogonal to the X direction. The direction orthogonal to the Y' direction is called the Z' direction (see FIG. 3 and others). The X-Y' plane is a plane parallel to the conveyance plane, and the Z' direction is a direction perpendicular to this conveyance plane. In this embodiment, the recording media include printing paper sheets (hereinafter simply referred to as paper sheets) and various kinds of films. In particular, the paper sheets include those manufactured using plant-derived mechanical pulp and/or chemical pulp. The types of recording media include coated paper such as gloss paper and matte paper, and uncoated paper such as plain paper and high-quality paper.

FIG. 1 is a diagram schematically showing the configuration of an image forming apparatus 1 including a paper sheet sensing device 18. As shown in FIG. 1, the image forming apparatus 1 includes an image forming apparatus main body 10 and a sheet feeding unit 20 that are mechanically and electrically connected to each other so as to communicate with each other.

(Image Forming Apparatus Main Body 10)

Figure 3:
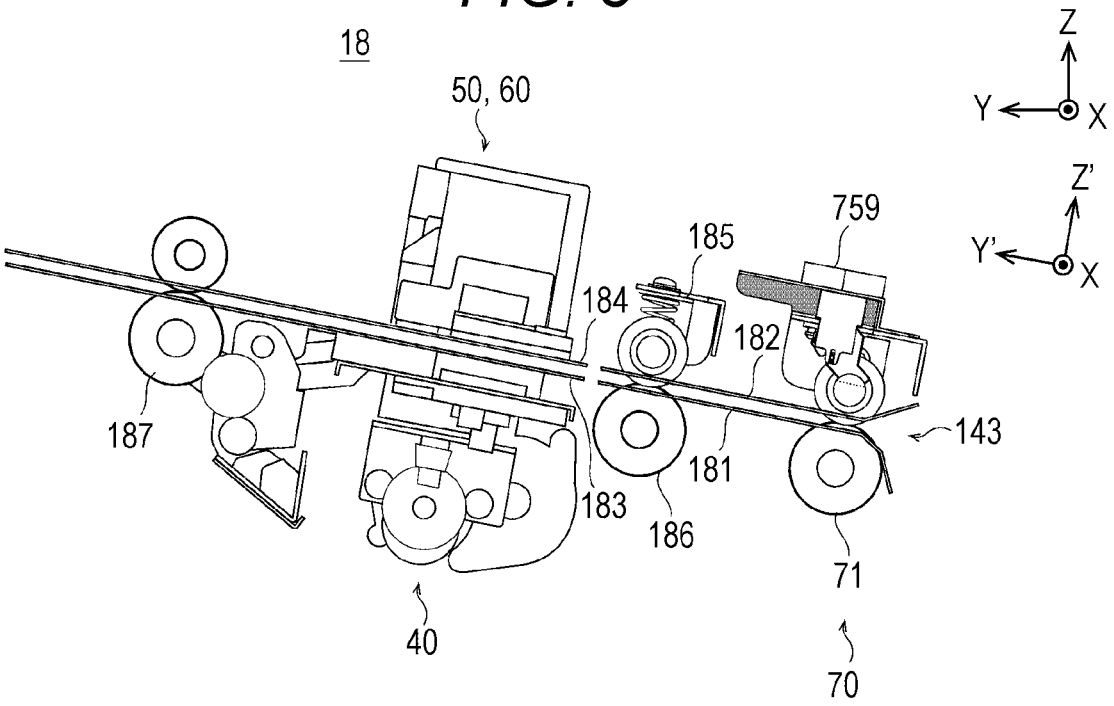
FIG. 3 is a cross-sectional view schematically showing the configuration of the paper sheet sensing device disposed in a conveyance path.

The image forming apparatus main body 10 includes a controller 11, a memory unit 12, an image former 13, a sheet feeder/conveyor 14, an operation panel 15, the paper sheet sensing device 18, and a communication unit (not shown). These components are connected to one another via a signal line such as a bus for exchanging signals. FIG. 3 is a side view showing the configuration of the paper sheet sensing device 18 disposed in a conveyance path 143. The paper sheet sensing device 18 is also called a media sensor, including a pressing mechanism 40 (see FIGS. 3 and 4), a basis weight sensor 50, a surface property sensor 60, and a sheet thickness sensor 70. The paper sheet sensing device 18 measures sheet characteristics. The basis weight sensor 50 is a transmissive first optical sensor, and the surface property sensor 60 is a reflective second optical sensor. The pressing mechanism 40 presses a paper sheet when the surface property sensor 60 senses sheet characteristics. The paper sheet sensing device 18 will be described later in detail.

(Controller 11)

The controller 11 includes a CPU, a ROM, and a RAM, and performs various kinds of processing by executing programs stored in the ROM and the memory unit 12 described later. According to the programs, the controller 11 controls the respective components of the apparatus and various kinds of arithmetic processing. The controller 11 functions as a determiner that determines the paper type from the results of detection performed by the two optical sensors or the paper sheet sensing device 18 including the two optical sensors.

(Memory Unit 12)

The memory unit 12 includes a ROM that stores various programs and various kinds of data in advance, a RAM that serves as a work area to temporarily store programs and data, and an auxiliary memory unit such as a hard disk that stores various programs and various kinds of data. The memory unit 12 also stores information about the paper sheets stored in the respective sheet feed trays. The information about the paper sheets includes the trade name of the paper sheets, the sizes (sheet widths, sheet length, and the like), the basis weights (weights), and the paper types (coated paper, plain paper, high-quality paper, rough paper, and the like). The information is set by the sheet type determining process described later. The memory unit 12 may also store a learnt model to be used for determining the trade names of paper sheets or the sheet types, and a paper profile (both of which will be described later).

(Image Former 13)

The image former 13 forms an image by an electrophotographic technique, for example. As shown in FIG. 1, the image former 13 includes writing units 131 corresponding to the respective primary colors of yellow (Y), magenta (M), cyan (C), and black (K), photoconductor drums 132, and developing devices 133 that contain two-component developers formed with toners and carriers of the respective colors. The image former 13 further includes an intermediate transfer belt 134, a secondary transfer unit 135, and a fixing unit 136. Toner images formed on the photoconductor drums 132 are superposed on one another on the intermediate transfer belt 134 by the developing devices 133 of the respective colors, and are transferred onto a conveyed paper sheet 300 at the secondary transfer unit 135. The toner image on the paper sheet 300 is then heated and pressed by the fixing unit 136 on the downstream side, and thus, is fixed to the paper sheet 300.

(Sheet Feeder/Conveyor 14)

The sheet feeder/conveyor 14 includes sheet feed trays 141 and 142, and conveyance paths 143 and 144. The conveyance paths 143 and 144 include pairs of conveyance rollers disposed along these conveyance paths, and a drive motor (not shown) that drives these pairs of conveyance rollers. The sheet feeder/conveyor 14 also includes feed rollers that send out the uppermost paper sheets of the paper sheets 300 stacked and placed in the sheet feed trays 141 and 142, and the paper sheets 300 in the sheet feed trays are sent one by one into the conveyance path on the downstream side. The paper sheet sensing device 18 is disposed on the upstream side of registration rollers in the conveyance path 143. As shown in FIG. 3, in the vicinity of the paper sheet sensing device 18, the conveyance path 143 is formed between guides formed with sheet metals or the like that face each other with a predetermined distance being kept in between. The guide plates include upper and lower guide plates 181 to 184 (see FIG. 3 described later). The paper sheets 300 pass through the conveyance path 143.

The sheet feeder/conveyor 14 conveys each paper sheet 300 sent from the sheet feed tray 141 or the like. A paper sheet 300 conveyed through the conveyance path 143 is subjected to image formation performed by the image former 13 to form an image thereon, and is then ejected onto a sheet catch tray 145. In a case where two-sided printing is performed to form an image on the back surface of a paper sheet 300, the paper sheet 300 having an image formed on one side is conveyed into the conveyance path 144 for two-sided image formation at a lower portion of the apparatus main body. The paper sheet 300 conveyed into this conveyance path 144 is turned over in a switchback path. After that, the paper sheet 300 enters the conveyance path 143, and an image is formed on the other surface of the paper sheet 300 by the image former 13.

(Operation Panel 15)

The operation panel 15 includes a touch screen, a numeric keypad, a start button, and a stop button, and displays the state of the image forming apparatus main body 10 or the image forming apparatus 1, information about the lives of the rollers (the timings of exchange), and the like. The operation panel 15 is used for setting the paper types and the like of the paper sheets stored in the sheet feed tray 141 and the like, and inputting instructions from the user.

(Sheet Feeding Unit 20)

As shown in FIG. 1, the sheet feeding unit 20 includes a sheet feeder/conveyor 24. In addition to the sheet feeder/conveyor 24, the sheet feeding unit 20 includes a controller, a memory unit, and a communication unit that communicates with the image forming apparatus main body 10 (none of these components is shown in the drawings), and these components are connected to one another via a signal line such as a bus for exchanging signals. The sheet feeder/conveyor 24 includes sheet feed trays 241, 242, and 243, and a conveyance path 244. The paper sheets 300 conveyed from each sheet feed tray are conveyed to the image forming apparatus main body 10 on the downstream side, and are subjected to sheet characteristics measurement at the paper sheet sensing device 18 and to image formation at the image former 13.

(Paper Sheet Sensing Device 18)

As described above, the paper sheet sensing device 18 includes the pressing mechanism 40, the basis weight sensor 50, the surface property sensor 60, and the sheet thickness sensor 70. As shown in FIG. 3, among these components, the sheet thickness sensor 70 is disposed on the upstream side in the conveyance direction, and the pressing mechanism 40, the basis weight sensor 50, and the surface property sensor 60 are disposed on the downstream side. The lower guide plate 181 and the upper guide plate 182 face each other at a predetermined distance being kept in between, the lower guide plate 183 and the upper guide plate 184 face each other at the predetermined distance being kept in between, and the conveyance path 143 is formed between these facing guide plates. In the conveyance path 143, conveyance roller pairs 71, 186, and 187 are disposed in this order from the upstream side. The configuration of the sheet thickness sensor 70 will be described later in detail.

Figure 4:
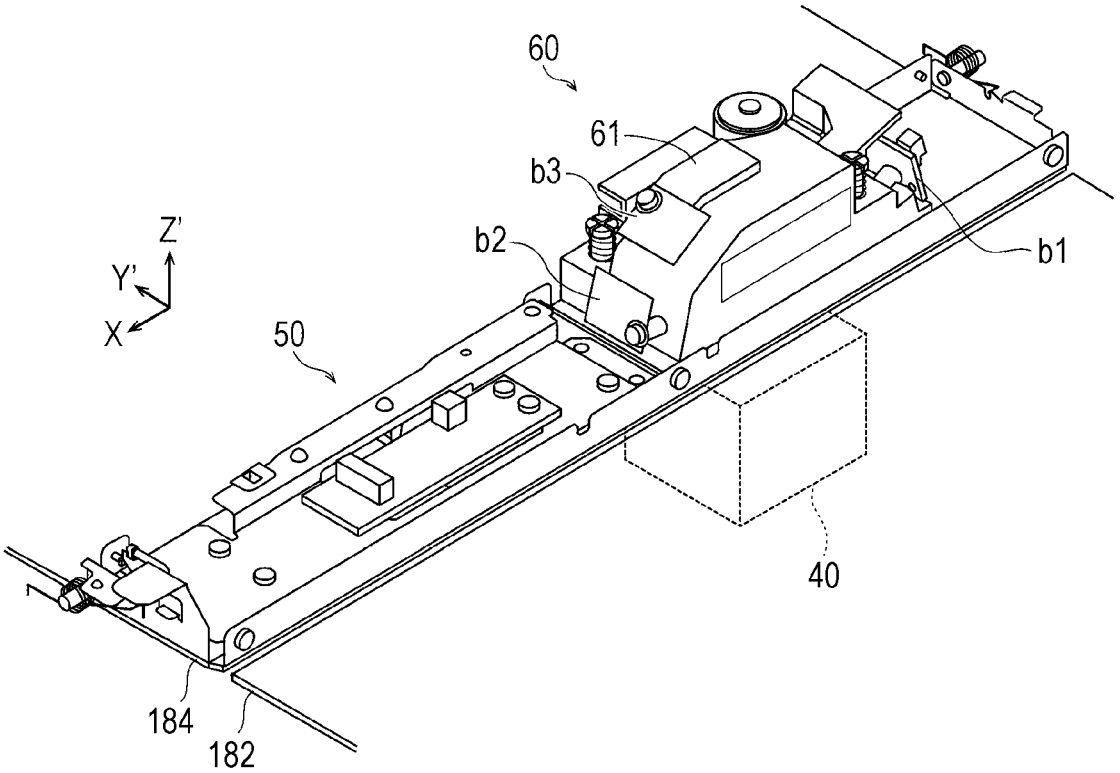
FIG. 4 is a perspective view showing the configurations of a basis weight sensor and a surface property sensor.

FIG. 4 is a perspective view showing the configurations of the basis weight sensor 50 and the surface property sensor 60. As shown in FIGS. 3 and 4, the basis weight sensor 50 and the surface property sensor 60 are disposed side by side in the X direction (the width direction) between the conveyance roller pairs 186 and 187. The pressing mechanism 40 is disposed below the surface property sensor 60 (on the negative side in the Z' direction). The pressing mechanism 40 is disposed below the lower guide plate 183. The pressing mechanism 40 includes a pressing unit, a drive motor, and a cam mechanism. The upper surface of the pressing unit is a flat surface that is driven up and down by the drive motor and is parallel to the lower guide plate 183. The upper surface of the pressing unit is usually in substantially the same plane as the lower guide plate 183, but moves up and pushes a paper sheet 300 toward the side of the surface property sensor 60 at a time of measurement.

As shown in FIG. 4, part of the basis weight sensor 50 (a light receiver) and the entire surface property sensor 60 are disposed above the upper guide plate 184.

(Basis Weight Sensor 50)

Figure 5:
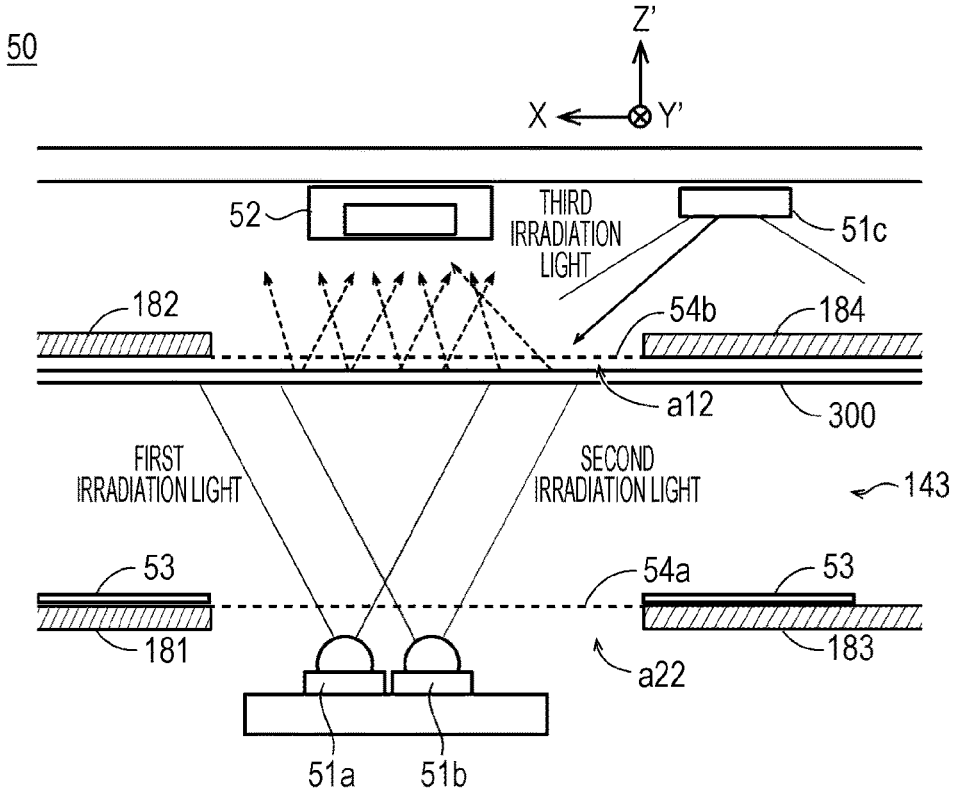
FIG. 5 is a schematic cross-sectional view showing the configuration of the basis weight sensor.

FIG. 5 is a schematic diagram showing the configuration of the basis weight sensor 50. The basis weight sensor 50 is a transmissive optical sensor that detects the basis weight of a paper sheet 300, includes light emitters and a light receiver, and measures the amount of attenuation (transmittance) of light that passes through the paper sheet 300.

As shown in FIG. 5, the basis weight sensor 50 includes a plurality of light emitters 51 and a single light receiver 52. The light emitters 51 include a first light emitter 51*a*, a second light emitter 51*b*, and a third light emitter 51*c*. The first, second, and third light emitters irradiate an irradiation region with a first irradiation light, a second irradiation light, and a third irradiation light, respectively. This irradiation region (a second irradiation region) is an inner region in an opening a12 when viewed from the Z' direction. The opening a12 is formed in the upper guide plate 184. An opening a22 is also formed in the lower guide plate 183 at the position facing the opening a12. The openings a12 and a22 have the same shape, and are rectangular, for example. To prevent adhesion of foreign matter such as paper dust generated from the paper sheet 300 passing through the conveyance path 143, transparent sheets 54*a* and 54*b* that are formed with PET or the like and allow light of the wavelengths of each irradiation light to pass are attached to the openings a12 and a22. Note that an opening a11 (see FIG. 6) for the surface property sensor 60 does not have any sheet attached thereto, and a shutter (not shown) in a closed state prevents adhesion of foreign matter when any measurement is not being performed.

The first light emitter 51*a* emits the first irradiation light having a first wavelength. The first wavelength is a near-infrared wavelength that is longer than the wavelength of visible light, for example. The second light emitter 51*b* emits the second irradiation light having a second wavelength. The second wavelength is the wavelength of blue light included invisible light, for example. The first light emitter 51*a* and the second light emitter 51*b* are both disposed on the opposite side of the conveyance path 143 from the light receiver 52, and the third light emitter 51*c* is disposed on the same side as the light receiver 52 and is located in the vicinity of the light receiver 52. The third light emitter 51*c* emits the third irradiation light having a third wavelength toward the irradiation region (the opening a12). The third wavelength is the wavelength of green light invisible light, for example.

The third irradiation light is emitted toward the conveyance path 143 in the upper and lower guide plates 183 and 184. A reflector 53 is provided on the inner side of the lower guide plate 183 in the vicinity of the first light emitter 51*a* and the second light emitter 51*b*. The reflector 53 is painted in the same green color as the third irradiation light, for example, and reflects the third irradiation light. Note that the reflector 53 does not reflect the first irradiation light (near-infrared light) and the second irradiation light (blue light) that are not in the same color as the reflector 53.

In this embodiment, the controller 11 controls the first light emitter 51*a* and the second light emitter 51*b* during measurement, so that the first light emitter 51*a* and the second light emitter 51*b* emit the first irradiation light and the second irradiation light at different timings from each other. The light receiver 52 receives the first irradiation light and the second irradiation light, detects the quantities of the respective irradiation lights, and outputs the detected light quantities of the first irradiation light and the second irradiation light to the controller 11. The first irradiation light and the second irradiation light are also emitted onto a paper sheet 300 conveyed to the position of the opening a12 in a similar manner. The light receiver 52 receives transmitted lights (a first transmitted light and a second transmitted light) of the first irradiation light and the second irradiation light, detects the quantities of the respective transmitted lights, and outputs the detected quantities of the first transmitted light and the second transmitted light to the controller 11. That is, the light receiver 52 detects the first irradiation light and the second irradiation light when any paper sheet 300 is not present, and detects the first transmitted light and the second transmitted light when a paper sheet 300 is present at the opening a12.

Likewise, as for the third light emitter 51*c*, the light receiver 52 detects a first reflected light reflected by the reflector 53 when any paper sheet 300 is not present, and a second reflected light reflected by the surface of a paper sheet 300 when the paper sheet 300 is present at the opening a12.

The controller 11 calculates a first transmittance by dividing the quantity of the first transmitted light by the quantity of the first irradiation light. Likewise, the controller 11 calculates a second transmittance by dividing the quantity of the second transmitted light by the quantity of the second irradiation light. The type of the paper sheet 300 is then determined from the first and second transmittances and the determination criteria stored in the memory unit 12.

In addition to the first and second transmittances, the controller 11 may also calculate a reflectance by dividing the quantity of the second reflected light by the quantity of the first reflected light, and determine the type of the paper sheet 300 from the first and second transmittances and the reflectance. Although adopted in this embodiment, the third light emitter 51*c* and the reflector 53 may be omitted.

(Surface Property Sensor 60)

Figure 6:
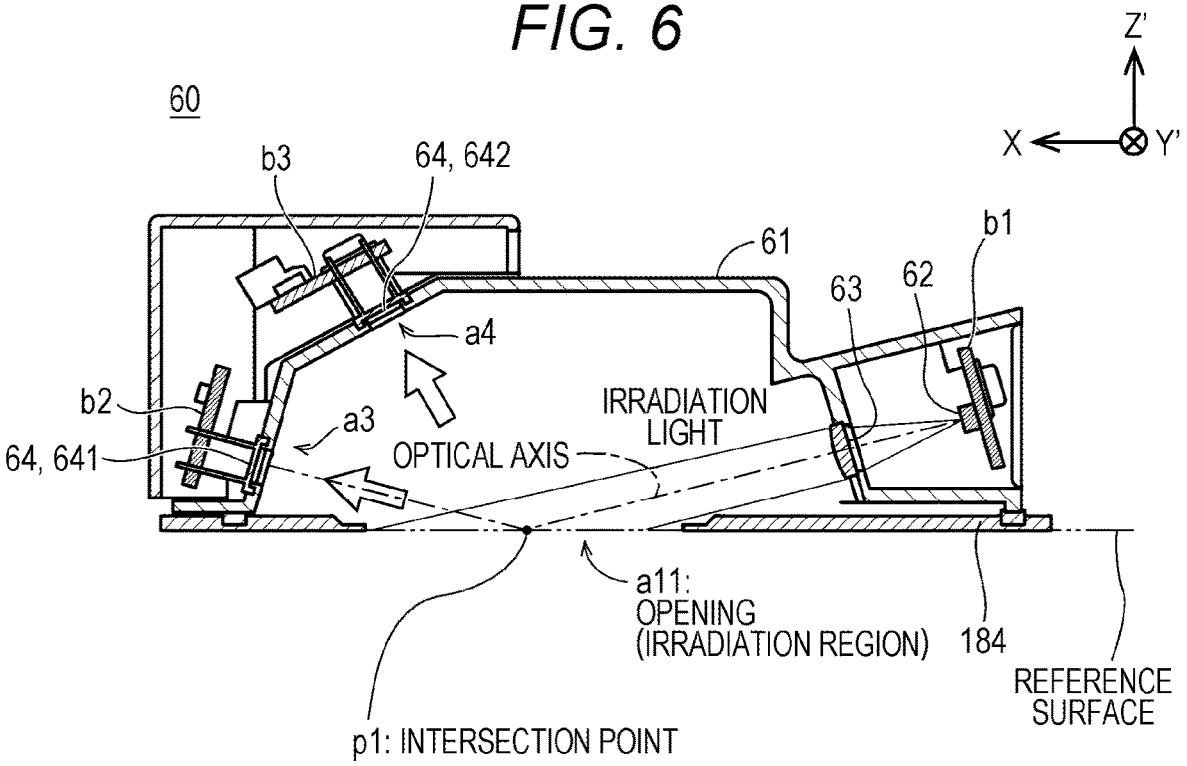
FIG. 6 is a schematic cross-sectional view showing the configuration of the surface property sensor.

Next, the configuration of the surface property sensor 60 is described, with reference to FIG. 6, as well as FIGS. 3 and 4. FIG. 6 is a cross-sectional view of the surface property sensor 60.

As shown in these drawings, the surface property sensor 60 includes a housing 61, a light emitter 62, a collimator lens 63, and a plurality of light receivers 64 (light receivers 641 and 642). The surface property sensor 60 also includes a shutter and an opening/closing mechanism for the shutter (neither of them is not shown in the drawings). The housing 61 covers the other components, and blocks external light.

As shown in FIG. 6, the position angle of the light emitter 62 is set so that the incident angle of irradiation light with respect to a reference surface is 75 degrees. This incident angle of 75 degrees is an angle that is used in JIS gloss measurement for white paper, and is an angle less affected by the color of the measured object. The reference surface is a virtual surface including the lower surface of the upper guide plate 184, and at a time of measurement, a surface of a paper sheet 300 that is the object to be measured is placed on the reference surface. The light emitter 62 is disposed on a substrate b1. The light emitter 62 includes a light-emitting element as a light source such as an LED that emits light of a predetermined wavelength, and irradiation light emitted from the light source (a point light source) is made substantially parallel light by the collimator lens 63 and is emitted onto the irradiation region. In this embodiment, the wavelength of the light source of the light emitter 62 is preferably greater than 405 nm but smaller than 525 nm, and the most preferable wavelength is about 465 nm. The irradiation region (a first irradiation region) is the inner region in the opening a11 when viewed from the Z' direction, and the center (the optical axis) of the irradiation region and the reference surface parallel to the X-Y' plane meet at an intersection point p1. As the light emitter 62, a surface-emitting LED may be used, or a bullet LED may be used.

Each of the light receivers 64 includes light receiving elements such as photodiodes or phototransistors, and includes a first light receiver 64 (a light receiver 641) that receives specularly reflected light from the irradiation region, and one or more second light receivers 64 (light receivers 642) that receive diffusely reflected light from the irradiation region. The first light receiver 641 is disposed at a position at a reflection angle of 75 degrees corresponding to the incident angle of 75 degrees of the light emitter 62, and receives specularly reflected light. Further, the second light receivers 642 can be disposed at positions at any reflection angles, except for the position at 75 degrees, within the reflection angle range of 0 degree or more to less than 90 degrees, and receives diffusely reflected light. The positions are preferably positions at reflection angles of 60 degrees, 30 degrees, and 0 degrees, or more preferably, two positions at 60 degrees and 30 degrees, or one position at 60 degrees. In the example illustrated in FIG. 6, the first light receiver 641 at the reflection angle of 75 degrees for receiving specularly reflected light, and the second light receivers 642 at the reflection angle of 30 degrees for receiving diffusely reflected light are adopted. In these drawings, the light receiver 641 is disposed on a substrate b2, and the light receivers 642 are disposed on a substrate b3.

(Sheet Thickness Sensor and Conveyor)

Figure 7:
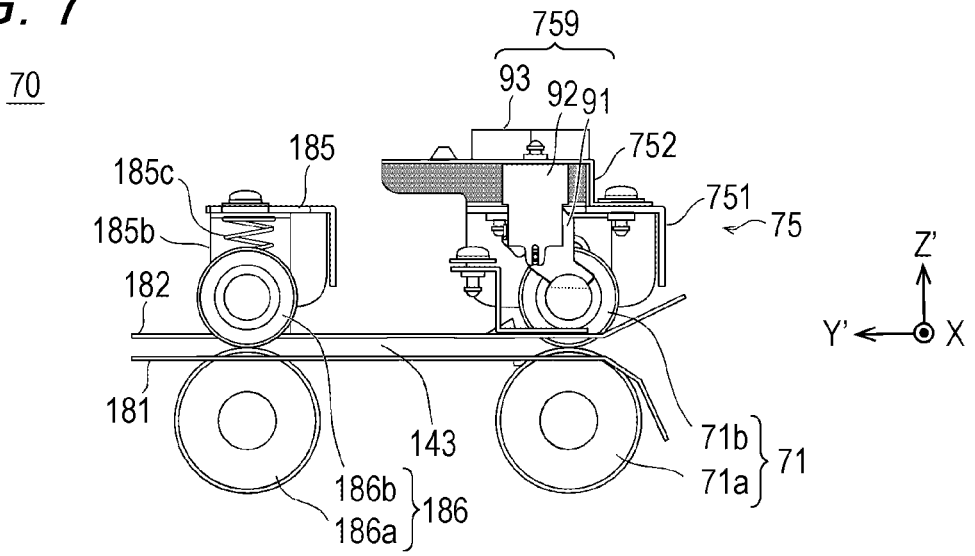
FIG. 7 is a schematic cross-sectional view showing the configuration of a sheet thickness sensor.
Figure 8:
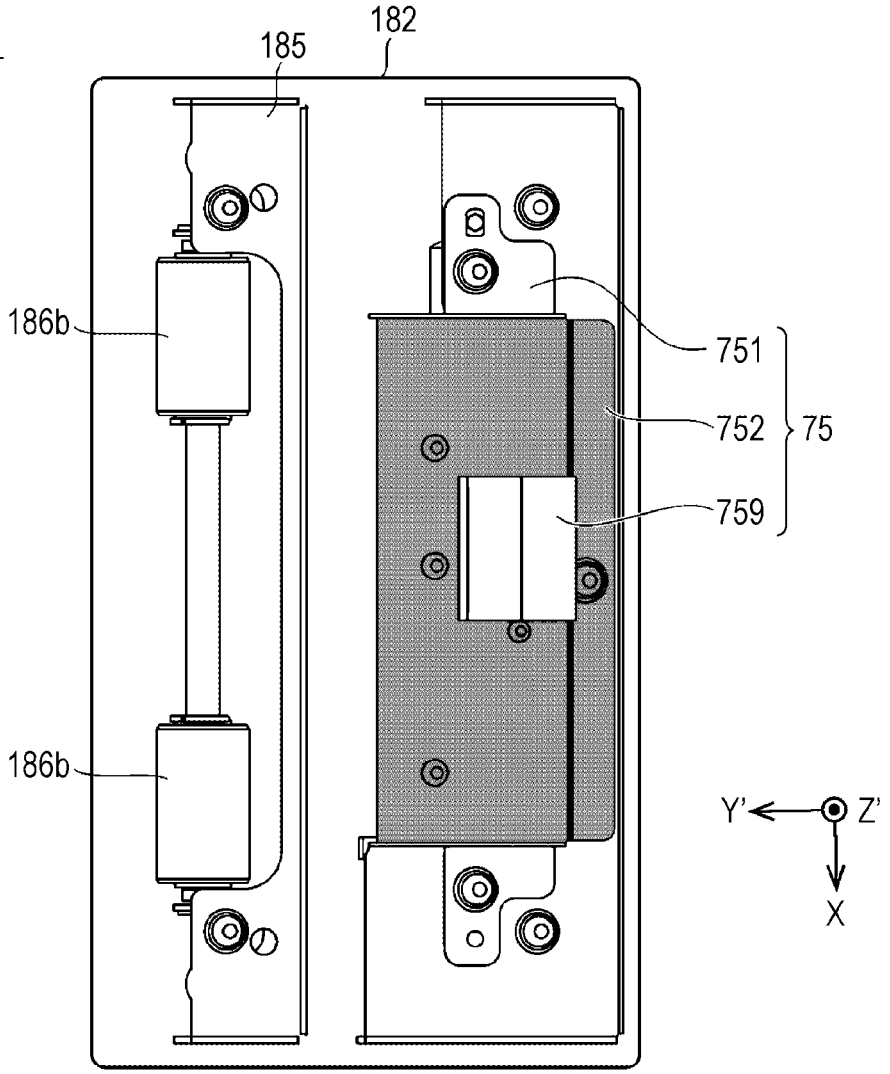
FIG. 8 is a top view of the sheet thickness sensor.
Figure 9A:
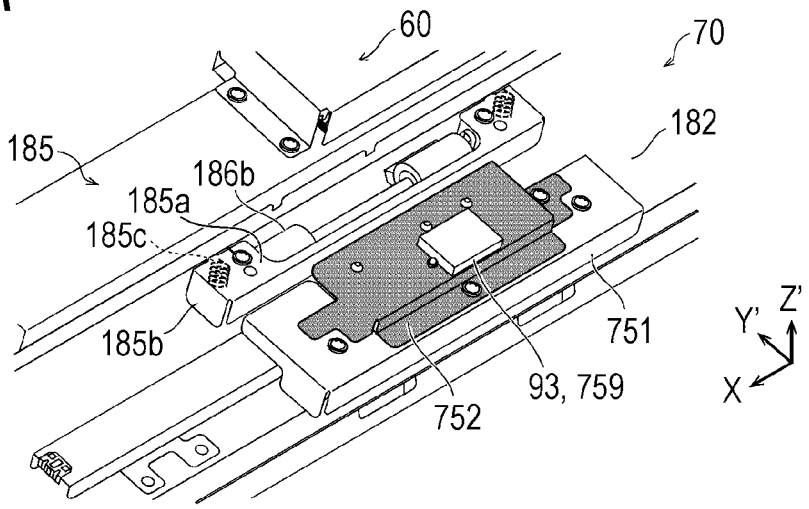
FIGS. 9A to 9C are perspective views showing the internal configuration of the sheet thickness sensor.
Figure 9B:
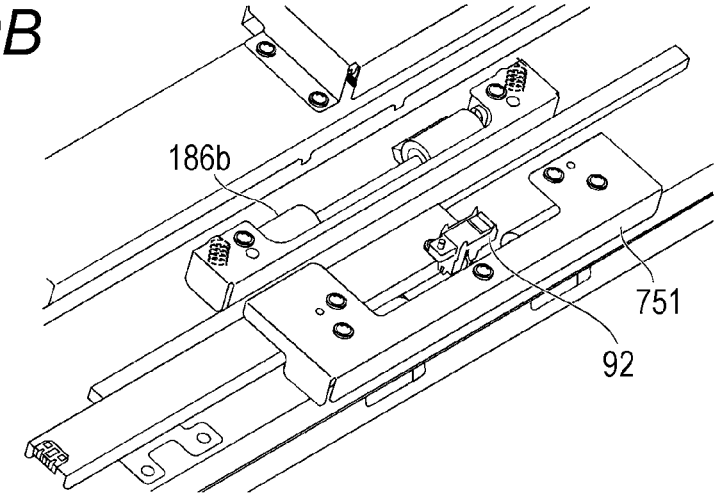
Figure 9C:
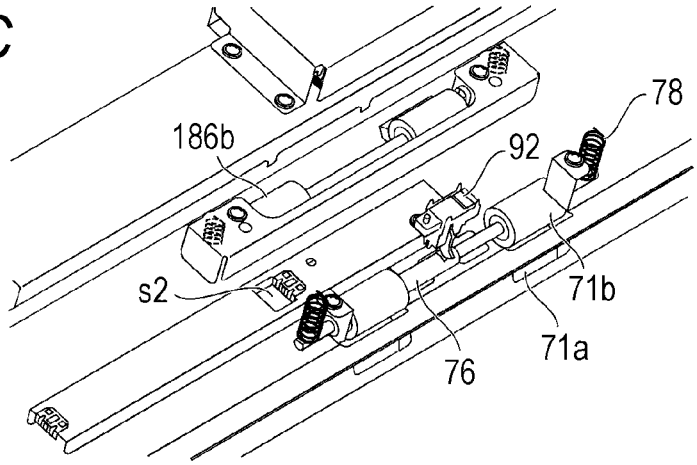
Figure 10:
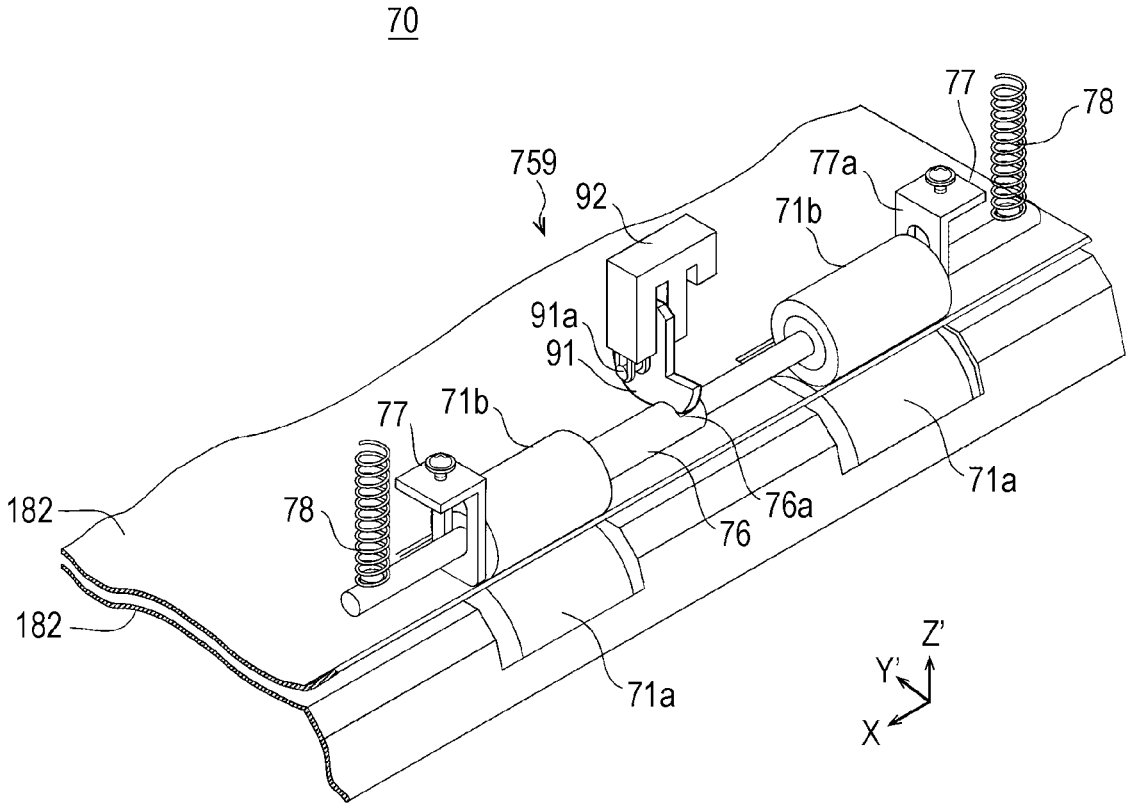
FIG. 10 is a perspective view showing the internal configuration of the sheet thickness sensor.

Next, the configuration of the sheet thickness sensor 70 is described with reference to FIGS. 7 to 11B. FIG. 7 is a schematic cross-sectional view showing a schematic configuration of the sheet thickness sensor. FIG. 8 and each of FIGS. 9A to 9C are a top view and a perspective view of the sheet thickness sensor 70, respectively. FIG. 10 is a perspective view of the internal configuration around a displacement sensor 759 of the sheet thickness sensor 70.

(Conveyor)

As shown in these drawings, the sheet thickness sensor 70 includes a conveyance roller pair 71 and a sensor unit 75. Further, a conveyance roller pair 186 is disposed adjacent to the downstream side of the sheet thickness sensor 70 in the conveyance direction. The sheet thickness sensor 70 and the conveyance roller pair 186 are both attached to one upper guide plate 182. Specifically, the upper roller 186*b* of the conveyance roller pair 186 is attached to the upper guide plate 182 by a roller pushing unit 185. A main body sheet metal 185*a* of the roller pushing unit 185 is screwed to the upper guide plate 182, and the roller shaft of the upper roller 186*b* is supported by a shaft support 185*b* provided on the upper guide plate 182 so that the roller shaft can move in the Z' direction. Further, the roller shaft of the upper roller 186*b* is pushed toward the lower roller 186*a* by two springs 185*c* provided at both ends. One end of each spring 185*c* is attached to the main body sheet metal 185*a*, and the other end is brought into contact with the roller shaft of the upper roller 186*b*. Here, the upper guide plate 182 and the conveyance roller pair 186 correspond to the "first attacher" and the "conveyor disposed adjacent to the sheet thickness sensor 70", respectively. That is, the conveyance roller pair 186 as a conveyor is attached to the upper guide plate 182, which is the first attacher, with the main body sheet metal 185*a* and the shaft support 185*b* of the roller pushing unit 185.

(Sheet Thickness Sensor 70)

One of the two rollers of the conveyance roller pair 71 is a fixed driving roller (its shaft center is fixed), and the other one is a driven roller that is pushed toward the driving roller so that the driven roller can be adjacent to the driving roller. In this embodiment, of the conveyance roller pair 71, the upper roller 71*b* is a driven roller (a second roller), and the lower roller 71*a* is a driving roller (a first roller) that rotates using a drive source (not shown). Each of the rollers 71*a* and 71*b* includes a plurality (two) rollers arranged side by side at a predetermined interval in the axial direction. As shown in FIGS. 7 and 8 and other drawings, the sensor unit 75 includes a roller pushing sheet metal 751, a sensor attacher 752, a roller shaft 76, shaft supports 77, springs 78, and the displacement sensor 759. The displacement sensor 759 includes a detection lever 91, a support 92, and a support attacher 93. The support attacher 93 of the displacement sensor 759 is attached to the roller pushing sheet metal 751 via the sensor attacher 752.

As shown primarily in FIG. 10, the axial directions of the lower roller 71*a* and the upper roller 71*b* are set parallel to the width direction of the paper sheet 300 being conveyed. Further, the upper roller 71*b* is rotatably supported by the columnar roller shaft 76.

The roller shaft 76 of the upper roller 71*b* is movably supported by the shaft supports 77 provided on the upper guide plate 182. The upper roller 71*b* functions as a reference member. When a paper sheet 300 is conveyed through a nip formed between the upper roller 71*b* and the lower roller 71*a*, the height position of the upper roller 71*b* changes by the amount equivalent to the thickness of the paper sheet 300. This height position is detected by the displacement sensor 759 as described later.

The shaft supports 77 and the upper guide plate 182 are formed by bending one sheet metal. The rotational movement of the roller shaft 76 is restricted by a rotation restricting member such as a bearing (not shown). Support holes 77*a* into which the roller shaft 76 is inserted are formed in the shaft supports 77. The support holes 77*a* are long holes having a predetermined length in the thickness direction. The roller shaft 76 is supported so as to be slidable in the thickness direction along the support holes 77*a* of the shaft supports 77.

Further, the length of the opening of each support hole 77*a* in the conveyance direction is designed to be greater than the diameter of the roller shaft 76. Therefore, a narrow gap is formed between the roller shaft 76 and the support holes 77*a* in the conveyance direction. Further, the roller shaft 76 is movably supported by the shaft supports 77 via the support holes 77*a* with a predetermined length in the conveyance direction.

The roller shaft 76 is pushed toward the lower roller 71*a* by the two springs 78 disposed at both ends. As shown in FIGS. 9A to 9C and FIG. 10, one end of each spring 78 is attached to the roller pushing sheet metal 751, and the other end is brought into contact with the roller shaft 76. The upper roller 71*b* supported by the roller shaft 76 with the springs 78 is pushed toward the lower roller 71*a*. When the lower roller 71*a* is rotationally driven, the upper roller 71*b* also rotates together with the lower roller 71*a*.

The springs 78 as pushing members are compression coil springs, for example. However, the pushing members are not necessarily compression coil springs, and some other elastic members of various kinds such as leaf springs or rubber may be adopted.

The roller shaft 76 has a flat portion 76*a* that is formed by cutting out part of its outer circumference in the axial direction. The detection lever 91 of the displacement sensor 759 is brought into contact with the flat portion 76*a*. The displacement sensor 759 includes the detection lever 91 to be brought into contact with the roller shaft 76, and the support 92 that supports the detection lever 91.

Figure 11A:
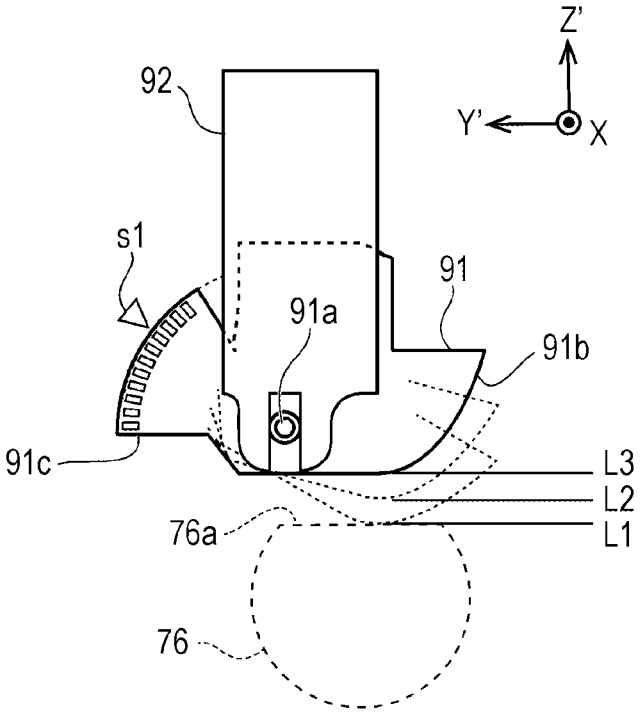
FIGS. 11A and 11B are diagrams for explaining a displacement sensor.
Figure 11B:
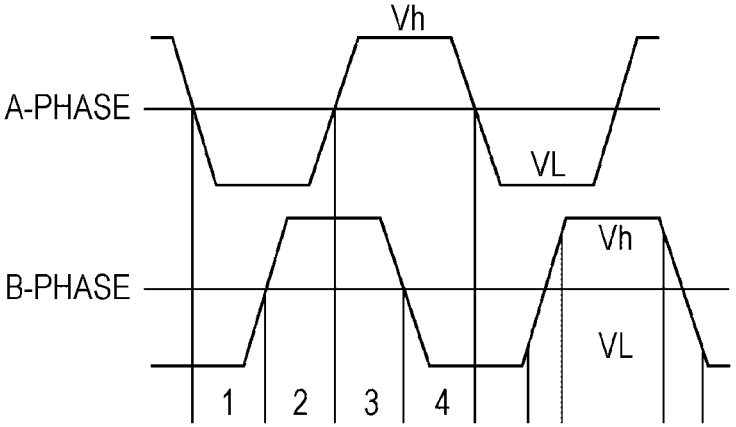

FIGS. 11A and 11B are diagrams for explaining the displacement sensor 759. As shown in FIGS. 10 and 11A, a contact surface 91*b* of the detection lever 91 to be brought into contact with the roller shaft 76 is formed in a substantially arc shape. The detection lever 91 is rotatably supported by the support 92 via a rotating shaft 91*a*. When the roller shaft 76 moves in the thickness direction (the Z' direction) in accordance with the thickness of the paper sheet 300 nipped by the conveyance roller pair 71, the detection lever 91 rotates about the support 92. In the displacement sensor 759, a disk portion 91*c* of the detection lever 91 and a transmissive optical sensor S1 function as an encoder, and detect the thickness of a paper sheet 300 from the rotation angle of the detection lever 91. FIG. 11B shows an example output of the two-phase encoder that is used in the displacement sensor 759, which detects the positional displacement (thickness) in the Z' direction with an accuracy of several microns.

In this example, the thickness of a paper sheet 300 is detected from the rotation angle of the detection lever 91. However, the embodiments are not limited to this example. As the displacement sensor 759, a measuring instrument for detecting displacement in the thickness direction of the roller shaft 76, and various other members may be adopted.

Further, an example in which the roller shaft 76 is adopted as the displacement member, and the detection lever 91 is brought into contact with the roller shaft 76 has been described, but the embodiments are not limited to this example. For example, an interlocking member that is displaced in the conveyance direction and the thickness direction together with the roller shaft 76 may be adopted as the displacement member. The displacement sensor 759 may bring the detection lever 91 into contact with the interlocking member, and detect the amount of displacement in the thickness direction of the upper roller 71*b* from the amount of displacement of the interlocking member.

Here, the sheet thickness sensor 70 is attached to the upper guide plate 182 as the first attacher with the roller pushing sheet metal 751 and the shaft supports 77. Specifically, the "roller pushing sheet metal 751" of the sheet thickness sensor 70 is screwed to the upper guide plate 182, and the sensor attacher 752 is screwed to this roller pushing sheet metal 751. The displacement sensor 759 is secured to this sensor attacher 752 with snap-fit portions and screws. Further, the upper roller 71*b* is attached to the upper guide plate 182 with the "roller pushing sheet metal 751" and the "shaft supports 77".

(Change in Output of the Displacement Sensor 759 of the Sheet Thickness Sensor 70 in the First Embodiment)

As described above, the sheet thickness sensor 70, and the conveyance roller pair 186 (a conveyor) that is disposed adjacent to the sheet thickness sensor 70 and nips a paper sheet are attached to the same upper guide plate 182 (the first attacher). Because of this, the output of the displacement sensor 759 changes, as the relative height positions of the displacement sensor 759 and the upper roller 71*b* (the reference member) of the sheet thickness sensor 70 shift depending on whether a paper sheet 300 is nipped by the conveyance roller pair 186, as will be described below.

FIGS. 12A to 12C and FIGS. 13A and 13B are diagrams for explaining the change in the output of the sheet thickness sensor 70 at each conveyance position of a paper sheet 300. FIG. 14 is a chart for explaining the relationship between the presence/absence of a paper sheet nipped by the downstream-side conveyance roller pair 186 and the change in the output of the displacement sensor.

Figure 12A:
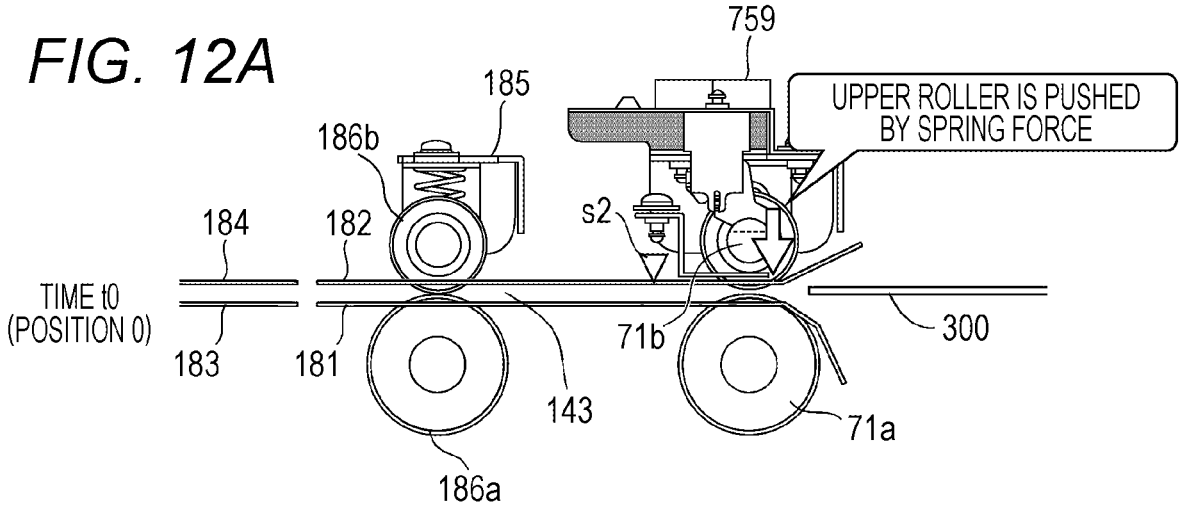
FIGS. 12A to 12C are diagrams for explaining the change in the output of the sheet thickness sensor at each conveyance position of a paper sheet.

At time t0 (position 0) shown in FIG. 12A, a paper sheet 300 conveyed from the sheet feed tray 141 or the like through the conveyance path 143 has not reached the sheet thickness sensor 70.

Figure 12B:
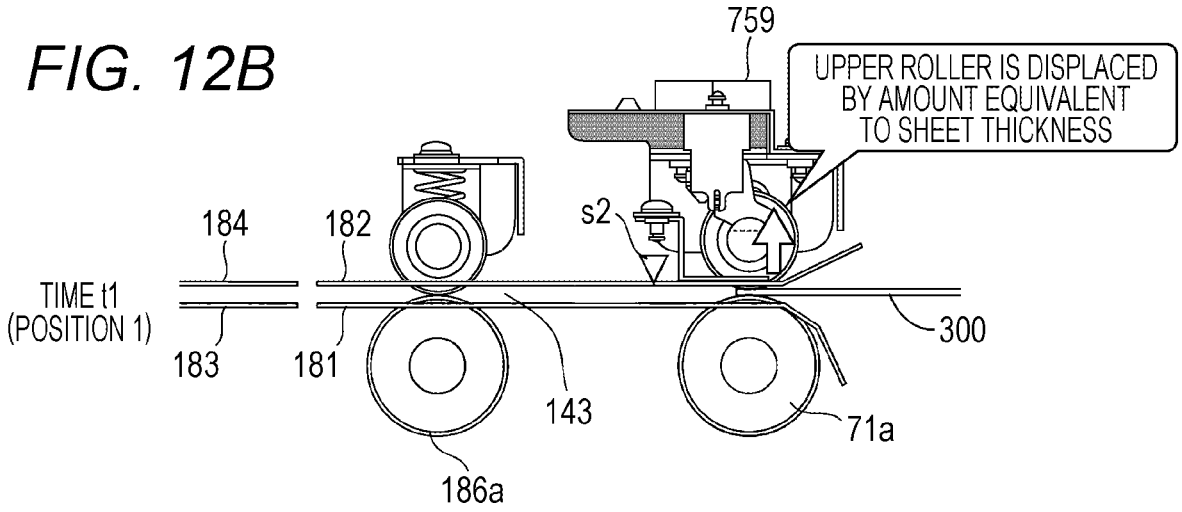

At time t1 (position 1) shown in FIG. 12B, the paper sheet 300 reaches the sheet thickness sensor 70, and its top edge is sandwiched by the nip of the conveyance roller pair 71. In this state, the height position of the upper roller 71*b* is displaced upward by the amount equivalent to the thickness of the paper sheet 300, and the displacement of the height position is sensed by the displacement sensor 759. Note that the controller 11 may hold the output of the displacement sensor 759 at time t0, and calculate the displacement amount (which is the thickness of the paper) at time t1, with the output being the reference.

Figure 12C:
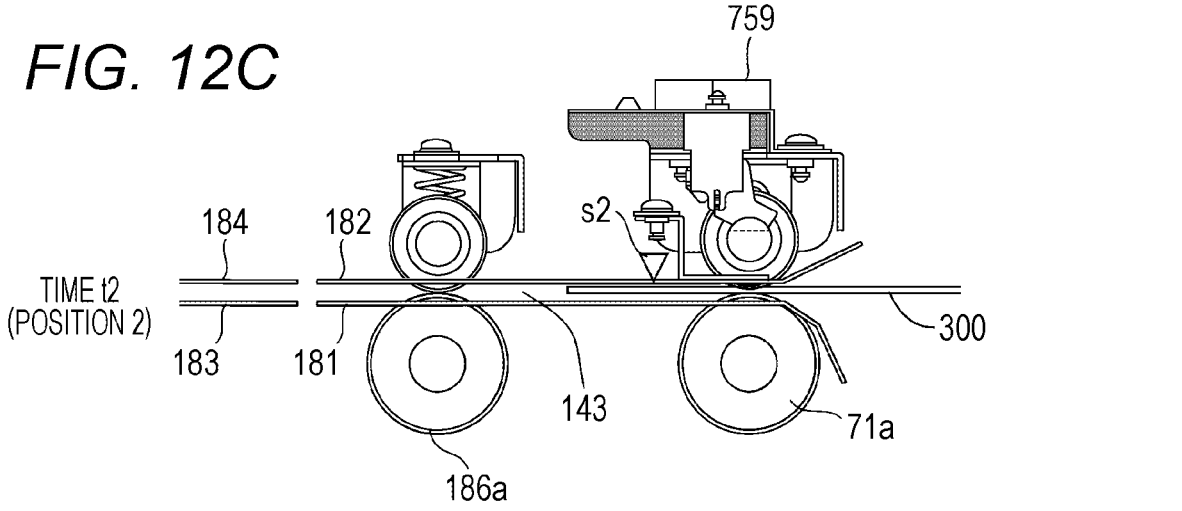

At time t2 (position 2) shown in FIG. 12C, the paper sheet 300 is located between the sheet thickness sensor 70 and the conveyance roller pair 186 on the downstream side.

Figure 13A:
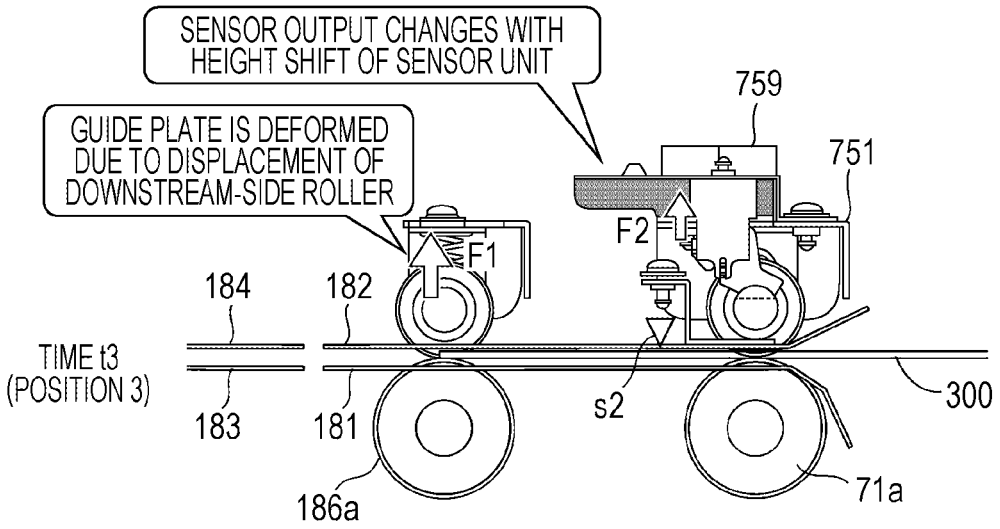
FIGS. 13A and 13B are diagrams for explaining the change in the output of the sheet thickness sensor at each conveyance position of a paper sheet.
Figure 14:
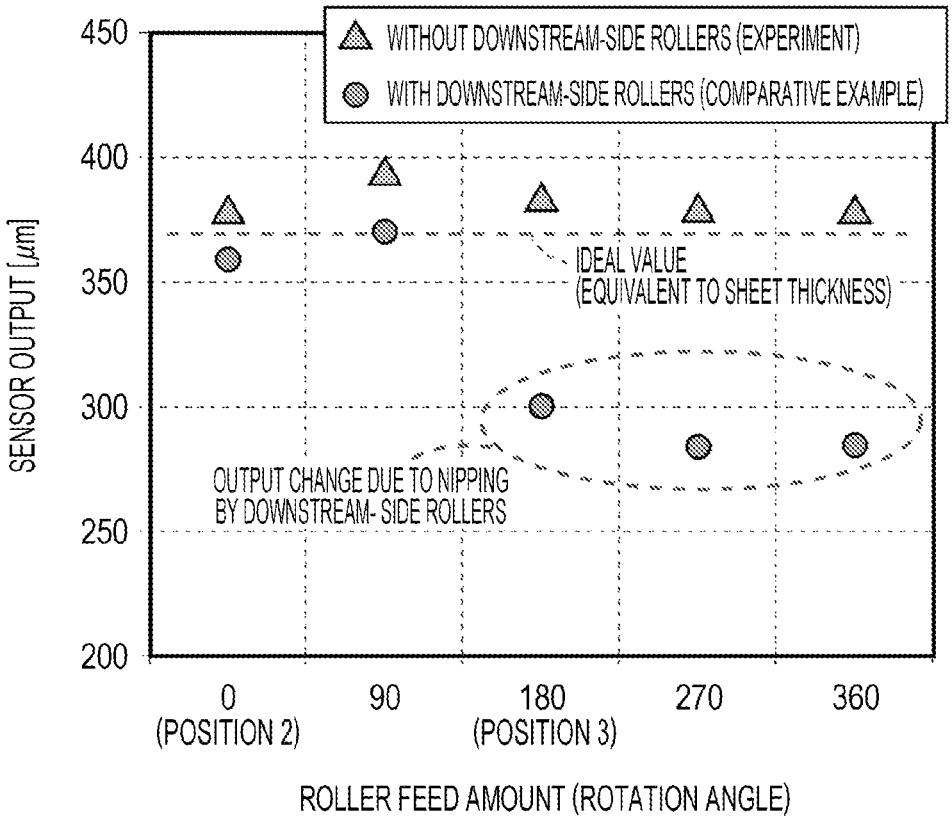
FIG. 14 is a chart for explaining the relationship between the presence/absence of a paper sheet nipped by a downstream-side conveyance roller pair and change in the output of the displacement sensor.

At time t3 (position 3) shown in FIG. 13A, the paper sheet 300 has reached the sheet thickness sensor 70 and the conveyance roller pair 186 on the downstream side. In this state, the upper roller 186*b* receives a force (F1) and is displaced upward by the amount equivalent to the thickness of the paper sheet 300, and the upper guide plate 182 is deformed via the roller pushing unit 185 due to the influence of the displacement. At this stage, the upper guide plate 182 is in a slightly raised state. The influence of the deformation of the upper guide plate 182 acts as an upward force (F2) on the sensor unit 75 via the roller pushing sheet metal 751, and this force causes the entire sensor unit 75 including the displacement sensor 759 (but excluding the upper roller 71*b*) to shift upward. On the other hand, the height of the upper roller 71*b* does not change, because the upper roller 71*b* remains pushed toward the paper sheet 300. Under these circumstances, the relative positional relationship between the upper roller 71*b* (the reference member) and the displacement sensor 759 changes, and therefore, the output changes accordingly (false sensing is performed on the thinner side).

Figure 13B:
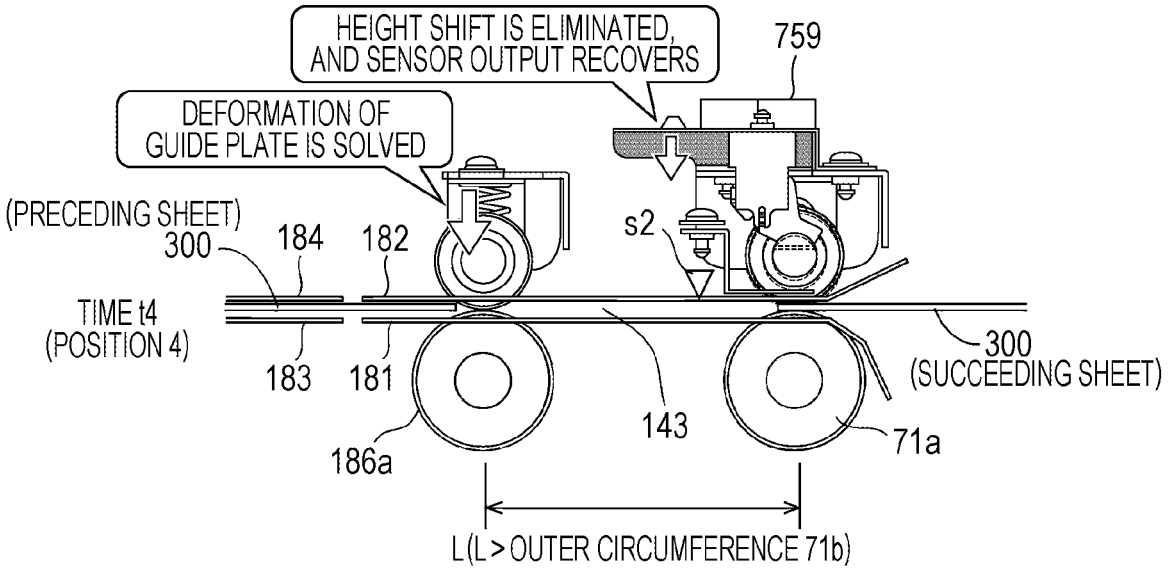

At time t4 (position 4) shown in FIG. 13B, the paper sheet 300 has passed through the sheet thickness sensor 70 and the conveyance roller pair 186, the deformation of the upper guide plate 182 is eliminated, and the height of the sensor unit 75 returns to the original position. Thus, the output of the displacement sensor 759 returns to the original normal state.

In FIG. 14, the abscissa axis indicates the roller feed amount, which corresponds to the rotation angle of the upper roller 71*b*. On the abscissa axis, 0 degrees corresponds to the position 2 shown in FIG. 12C, and 180 degrees corresponds to the position 3 shown in FIG. 13A. The ordinate axis indicates the output of the displacement sensor 759 converted into length (sheet thickness), and the horizontal dashed line indicates the ideal value for the thickness of the paper sheet 300 used in the test. The triangles in the example chart indicate the outputs in a case where the conveyance roller pair 186 on the downstream side is experimentally removed, and the circles indicate the outputs in a case where the conveyance roller pair 186 on the downstream side is provided as shown in FIGS. 12A to 12C, FIGS. 13A and 13B, and others. As can be seen from the above, there is an output change (error) of about 50 to 80 μm, depending on the presence/absence of a paper sheet 300 nipped by the conveyance roller pair 186 on the downstream side.

The distance between the sheet thickness sensor 70 and the conveyance roller pair 186, or more specifically, the distance between the nip of the conveyance roller pair 71 and the nip of the conveyance roller pair 186 in the conveyance direction is now described. This distance L is shorter than the length of the minimum size (such as the standard postcard size or B6, for example) suitable for image formation by the image forming apparatus 1, and is longer than the outer circumference of the roller 71*b*. The reason why the distance Lis shorter than the minimum size is that conveyance is to be performed with adjacent rollers. The reason why the distance L is longer than the outer circumference is that the sheet thickness continues to be sensed over the time equivalent to one revolution of the roller 71*b*, and the obtained measurement values are averaged, so as to reduce the influence of an error of the outer diameter (the diameter) of the roller 71*b*.

(Sheet Thickness Sensing Process)

Figure 15:
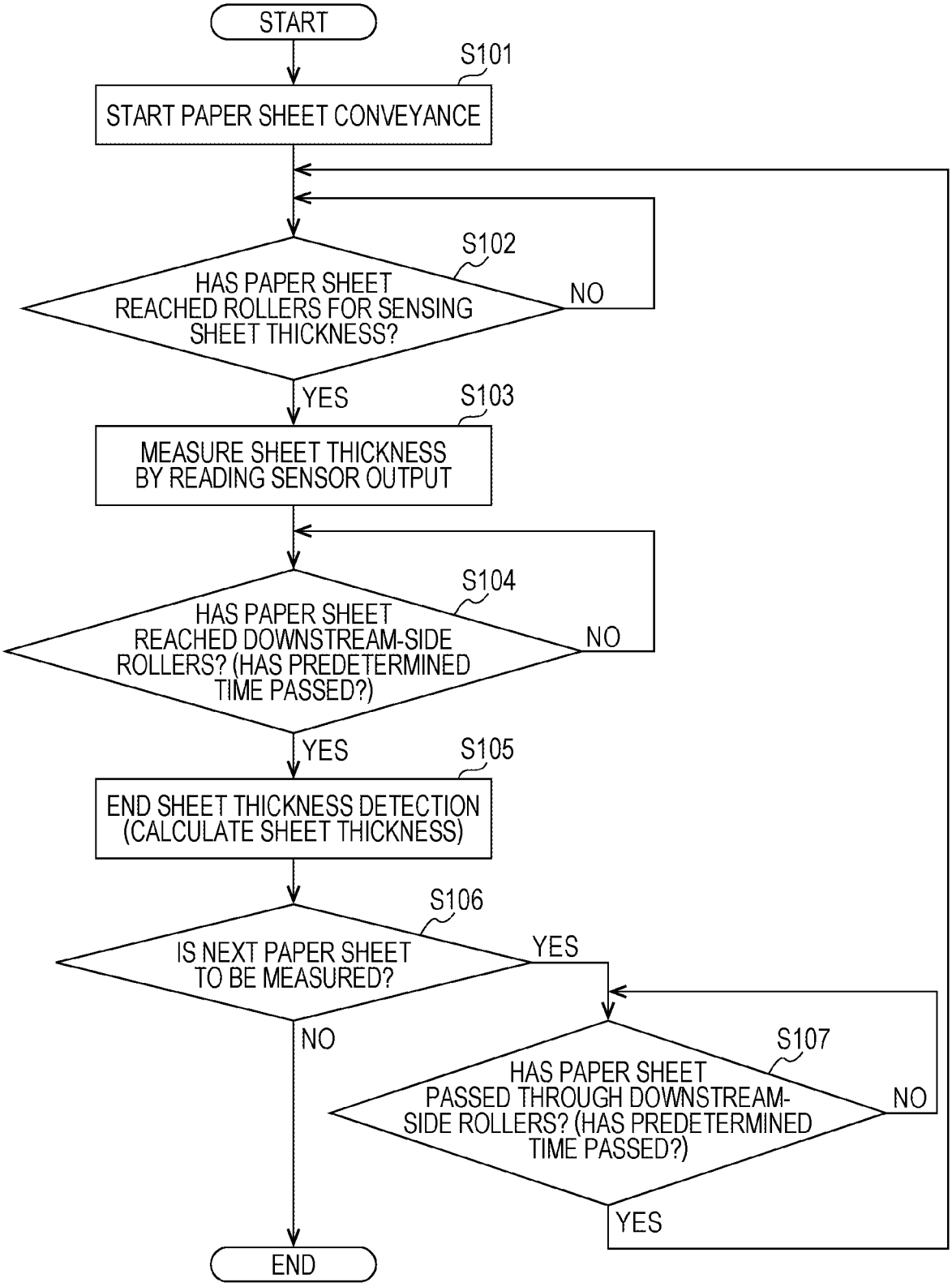
FIG. 15 is a flowchart showing a sheet thickness sensing process (a first displacement preventer) to be performed by the paper sheet sensing device according to the first embodiment.

FIG. 15 is a flowchart showing a sheet thickness sensing process to be performed by the paper sheet sensing device 18 according to the first embodiment. In the first embodiment described below, the controller 11 that controls the paper sheet sensing device 18 functions as a first displacement preventer.

(Step S101)

The controller 11 controls the sheet feeder/conveyor 14, to convey a paper sheet 300 having specific sheet characteristics from the sheet feed tray 141 or the like. If the mode for conducting measurement on a plurality of paper sheets 300, or the mode for measuring the sheet characteristics of paper sheets 300 while continuously forming images is set, paper sheets 300 are continuously conveyed from the sheet feed tray 141 at predetermined sheet intervals.

(Step S102)

A check is determined whether the paper sheet 300 has reached the conveyance roller pair 71 of the sheet thickness sensor 70. If the paper sheet 300 has reached the conveyance roller pair 71 (YES), the process moves on to step S103. At a sensor S2 that senses the presence/absence of a paper sheet in the conveyance path 143 (see FIGS. 12A to 12C and others), or in the conveyance path 143, this determination can be made from the output of a sensor disposed on the upstream side of the sensor S2.

(Step S103)

The controller 11 reads the output of the displacement sensor 759, and acquires a measurement value. At this time, it is preferable to continue measurement a plurality of times at predetermined intervals, so as to reduce the influence of an error of the outer diameter of the roller 71*b*.

(Step S104)

If the paper sheet 300 has reached the downstream-side conveyance roller pair 186 (YES), the process moves onto step S105. This determination can be made, depending on whether a predetermined time has passed since a change in the output of the sensor S2. This state corresponds to the position 3 shown in FIG. 13A.

(Step S105)

The controller 11 ends the sheet thickness detection, and detects the sheet thickness from the measurement value obtained in step S103. For example, the sheet thickness is detected by averaging the measurement values obtained during the period corresponding to one revolution of the roller 71*b*.

(Step S106)

The controller 11 is set in the mode for continuous measurement. If the next paper sheet is to be measured (YES), the process moves onto step S107. If the next paper sheet is not to be measured (NO), on the other hand, the process comes to an end (END).

(Step S107)

A check is made to determine whether the paper sheet 300 has passed through the downstream-side conveyance roller pair 186. If the paper sheet 300 has passed through the conveyance roller pair 186, the process returns to step S102, and the steps that follow are repeated. This state in which the paper sheet 300 has passed through the conveyance roller pair 186 corresponds to the position 4 shown in FIG. 13B.

As described above, this embodiment includes a displacement preventer that prevents change in the output of the displacement sensor due to a shift of the relative height position of the reference member, depending on the presence/absence of a recording medium nipped by a conveyor when the sheet thickness sensor 70 senses the sheet thickness. Particularly, in the first embodiment, the controller 11 as the displacement preventer controls the period during which the sheet thickness sensor 70 senses the sheet thickness at the timing when the recording medium passes through the nip of the conveyance roller pair 186 (a conveyor). More specifically, a period excluding the timing at which the recording medium passes through the nip of the conveyance roller pair 186 is set. For example, the period excluding the timing at which the recording medium passes through the nip is the period from the arrival of a paper sheet 300 at the conveyance roller pair 71 to the time immediately before the paper sheet 300 reaches the conveyance roller pair 186 on the downstream side. Alternatively, in a case where measurement is carried out while paper sheets are successively conveyed, the period is from the time when the previous paper sheet passes through the conveyance roller pair 186 to the time immediately before the next paper sheet reaches the conveyance roller pair 186. With such a paper sheet sensing device according to the first embodiment, it is possible to prevent a change in the output of the displacement sensor due to a shift in the relative height position of the reference member, depending on the presence/absence of a recording medium nipped by a conveyor.

(Printing Process)

Figure 16:
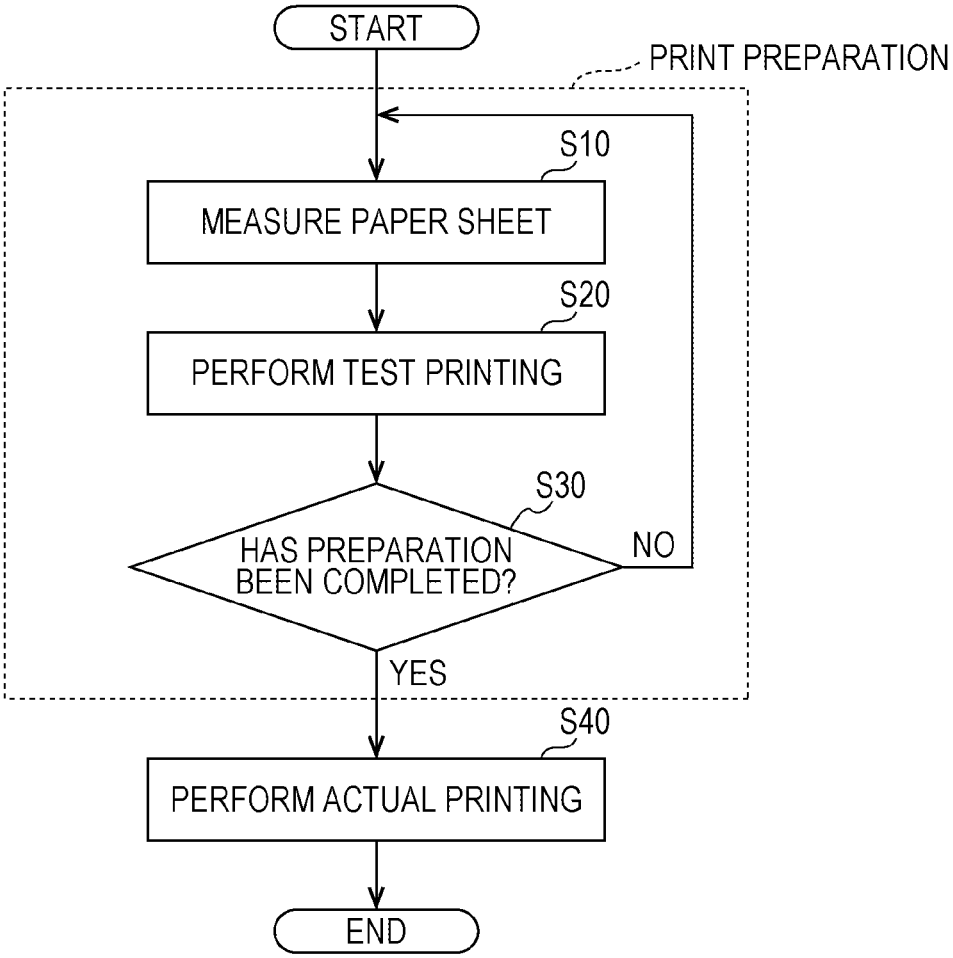
FIG. 16 is a flowchart showing a printing process in the image forming apparatus.

Next, a printing process using a sheet type determining process including the above sheet thickness sensing process illustrated in FIG. 15 is described. FIG. 16 is a flowchart showing a printing process to be performed in the image forming apparatus 1.

(Step S10)

The user operates sheet setting buttons on the operation screen (not shown) displayed on the operation panel 15. Receiving this operation from the user, the controller 11 starts sheet setting. The instruction to start this sheet setting includes selection information regarding one or more sheet feed trays (sheet feed trays 141 and 142, and 241 to 243) in which paper sheets to be measured are stored. This sheet setting process includes the following procedures. Sheet characteristics are measured by the paper sheet sensing device 18. The sheet characteristics to be measured include the basis weight, the surface properties, and the sheet thickness to be measured by the basis weight sensor 50, the surface property sensor 60, and the sheet thickness sensor 70, respectively. Of these measurements, the sheet thickness measurement by the sheet thickness sensor 70 is performed through the process shown in FIG. 15. The controller 11 then determines the paper type and measures the basis weight classification, on the basis of the measurement values of the basis weight, the surface properties, and the sheet thickness. This determination may be performed on a rule basis, and the paper type determination and the basis weight classification determination are performed using a learnt model (a paper type determination engine) and a paper profile. Here, the "paper profile" is registered beforehand for a paper sheet. In the paper profile, the measurement value of the paper sheet measured by the paper sheet sensing device 18, and the characteristics data, the sheet size, the identification name (such as the brand name), and the like, which have been input by the user, are associated with one another. The "paper type determination engine" is also called a learnt model, and the learnt model has been generated through supervised learning using supervisor data, with the input value being the sensor output from the paper sheet sensing device 18 regarding the paper sheet 300, the answer label being the paper type information that has been set by the user regarding the paper sheet 300.

(Step S20)

When the sheet setting is completed, the image forming conditions are set in accordance with the set sheet characteristics, and test printing of the print job is performed.

(Step S30)

If the result of the test printing is unsatisfactory, or if a plurality of types of paper sheets are to be used in one print job, the user repeats the process starting from step S10 for the other paper sheets (step S30: NO). If the result of the test printing is satisfactory, and a11 the sheet types have been checked (YES), the controller 11 receives a preparation completing operation from the user, and moves on to step S40.

(Step S40)

The controller 11 controls the image former 13 and others to execute the print job (actual printing), and thus, completes the printing process (END).

As described above, the image forming apparatus 1 according to this embodiment determines the paper type of a paper sheet (a recording medium), using detection results supplied from the paper sheet sensing device 18. In this manner, the paper type can be determined accurately, and the image forming conditions for the paper type are set so that high-quality printed matter can be output.

Second Embodiment

In the first embodiment shown in FIGS. 7 to 14, the sheet thickness sensor 70, and the conveyance roller pair 186 (a conveyor) that is disposed adjacent to the sheet thickness sensor 70 and nips a paper sheet are attached to the same upper guide plate 182 (the first attacher). Therefore, deformation of the first attacher depending on the presence/absence of a paper sheet nipped by the conveyance roller pair 186 causes a shift of the relative height positions of the displacement sensor 759 and the reference member (the roller 71*b*) of the sheet thickness sensor 70. In the second embodiment described below, on the other hand, the first attacher is prevented from being deformed depending on the presence/absence of a paper sheet nipped by the conveyance roller pair 186.

Figure 17A:
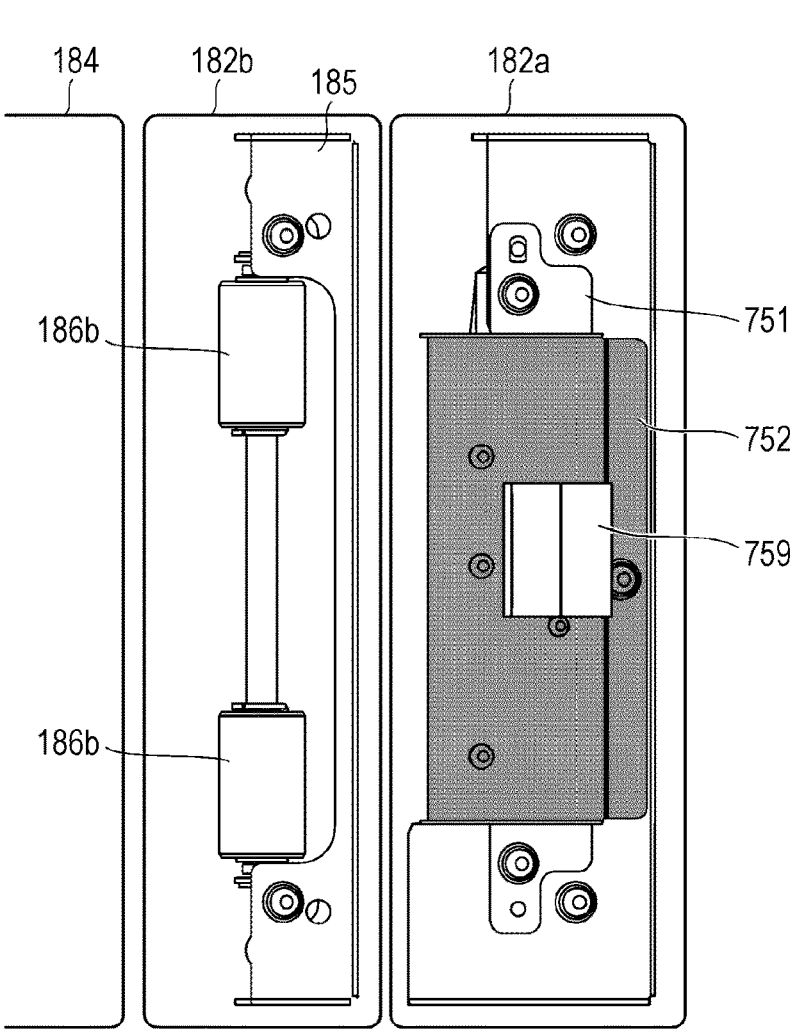
FIGS. 17A and 17B are diagrams showing the configuration of a second displacement preventer of a paper sheet sensing device according to a second embodiment.
Figure 17B:
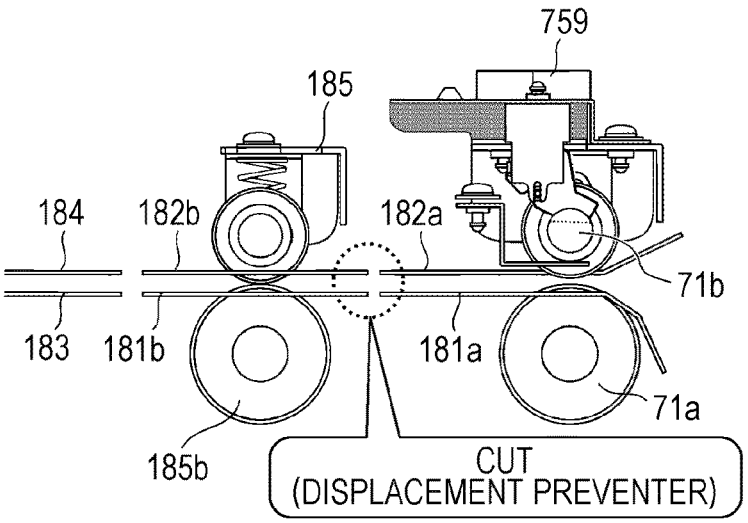

FIGS. 17A and 17B are diagrams showing the configuration of a second displacement preventer of the paper sheet sensing device 18 according to the second embodiment. In the second embodiment, the second displacement preventer is a second attacher. This second attacher is independent of the first attacher, so that deformation of the second attacher does not affect the first attacher.

Specifically, as shown in FIGS. 17A and 17B, the conveyance roller pair 186 is attached to an upper guide plate 182*b* serving as the second attacher, and the sheet thickness sensor 70 is attached to an upper guide plate 182*a* serving as the first attacher. A cut (a gap) is formed between the first and second attachers, and the two attachers are independent of each other. Both the first and second attachers are attached to the housing of the image forming apparatus main body 10. In FIGS. 17A and 17B, each guide plate is shown in gray for ease of viewing (the same applies to FIGS. 18 and 19).

The force derived from deformation of the second attacher depending on the presence/absence of a paper sheet nipped by the conveyance roller pair 186 is not transmitted to the first attacher and does not affect measurement to be performed by the sheet thickness sensor 70. In this manner, the same effects as those of the first embodiment can be achieved. Further, in the second embodiment, measurement timings are not limited as in the first embodiment, and sensor outputs can be acquired over the entire period during which a paper sheet 300 is nipped by the conveyance roller pair 71. Thus, the sheet thickness can be measured with higher accuracy.

Third Embodiment

In the second embodiment, a gap is formed between the first attacher to which the sheet thickness sensor 70 is attached and the second attacher to which the conveyance roller pair 186 is attached, so that deformation force does not propagate. Ina third embodiment, the sheet thickness sensor 70 and the conveyance roller pair 186 are attached to the same first attacher (an upper guide plate 182*c*), but a hole or a thin slit in a strip-like shape is formed as a third displacement preventer in a region located between the attachment position of the sheet thickness sensor 70 and the attachment position of the conveyance roller pair 186 in the first attacher.

Figure 18:
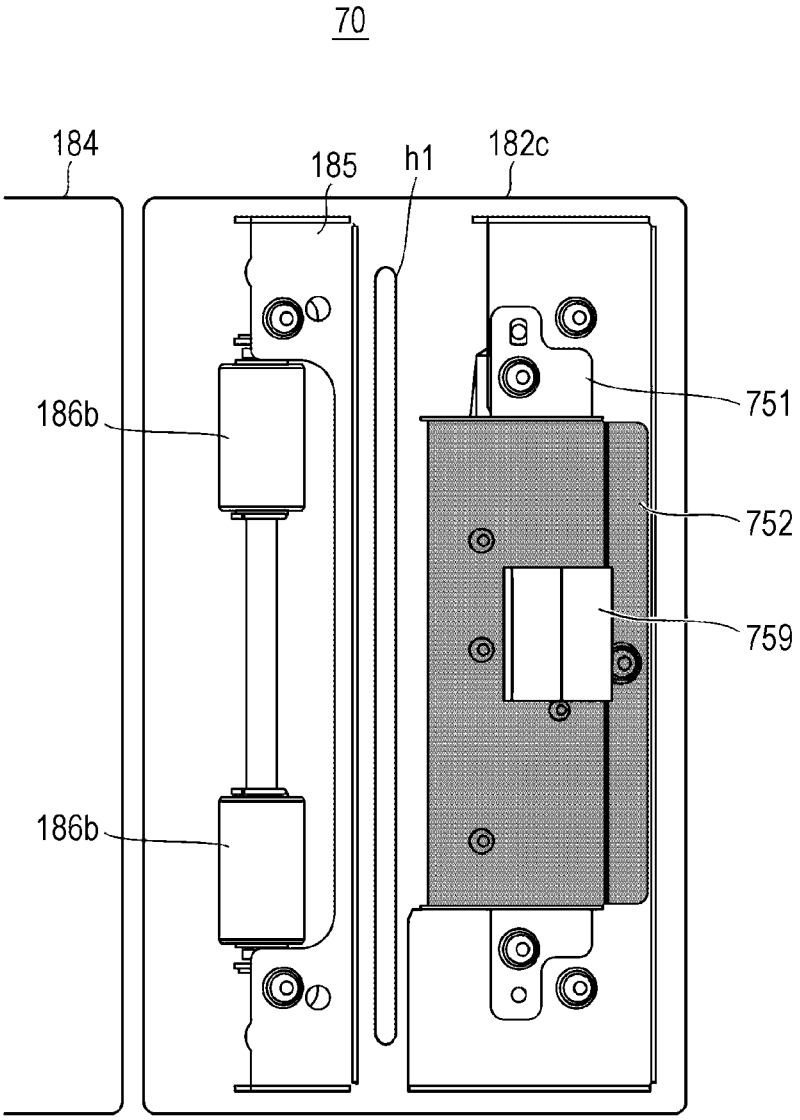
FIG. 18 is a diagram showing the configuration of a third displacement preventer of a paper sheet sensing device according to a third embodiment.

Specifically, as shown in FIG. 18, the upper guide plate 182*c* having a slit-like hole h1 formed therein is used. As the hole h1 is formed in this manner, the rigidity of the upper guide plate 182*c* becomes lower, and the force derived from deformation of the first attacher depending on the presence/absence of a paper sheet nipped by the conveyance roller pair 186 is not easily transmitted to the sheet thickness sensor 70 and hardly affects measurement to be performed by the sheet thickness sensor 70. In this manner, the same effects as those of the second embodiment can be achieved.

Figure 19:
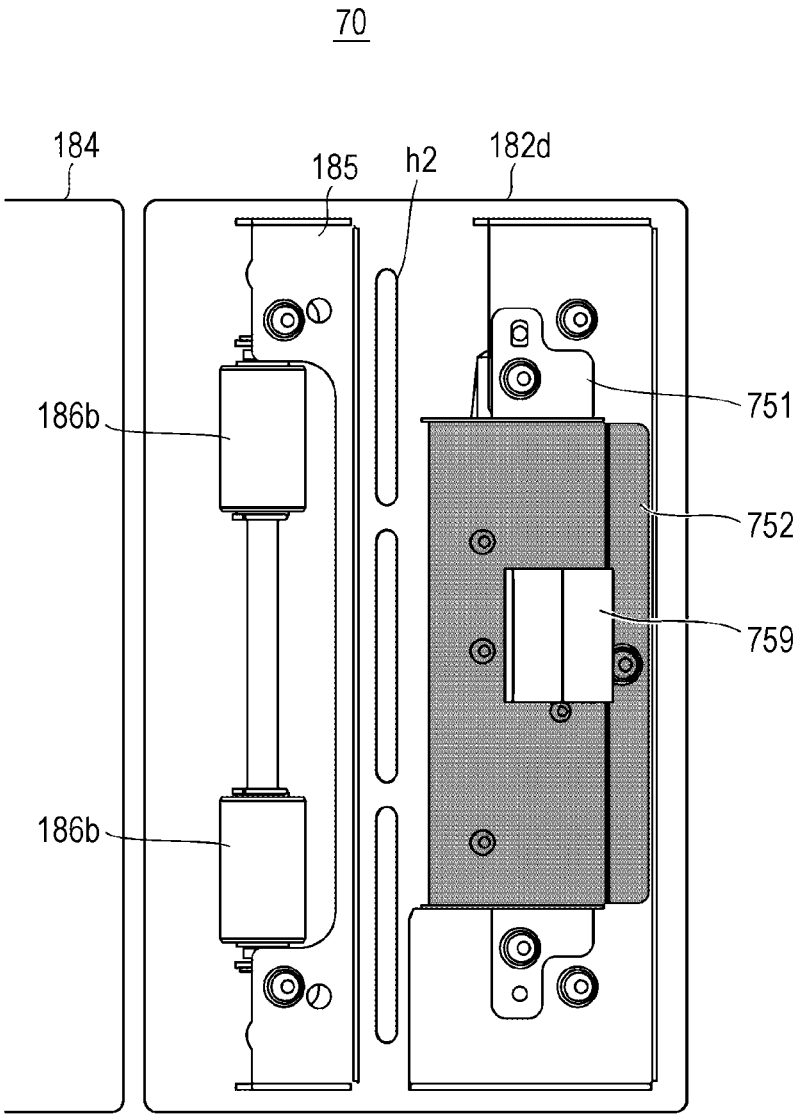
FIG. 19 is a diagram showing the configuration of a fourth displacement preventer of a paper sheet sensing device according to a modification of the third embodiment.

FIG. 19 is a diagram showing the configuration of a fourth displacement preventer of a paper sheet sensing device according to a modification of the third embodiment. The number of holes is not limited to one, and a plurality of holes h2 may be provided as in the fourth displacement preventer shown in FIG. 19. Further, instead of holes or slits, or in combination with holes or slits, a thin part formed by reducing the thickness of the sheet metal may be formed. In such a modification, the same effects as those of the second embodiment can also be achieved.

(Roller Life Predicting or Abnormality Determining Process)

Figure 20:
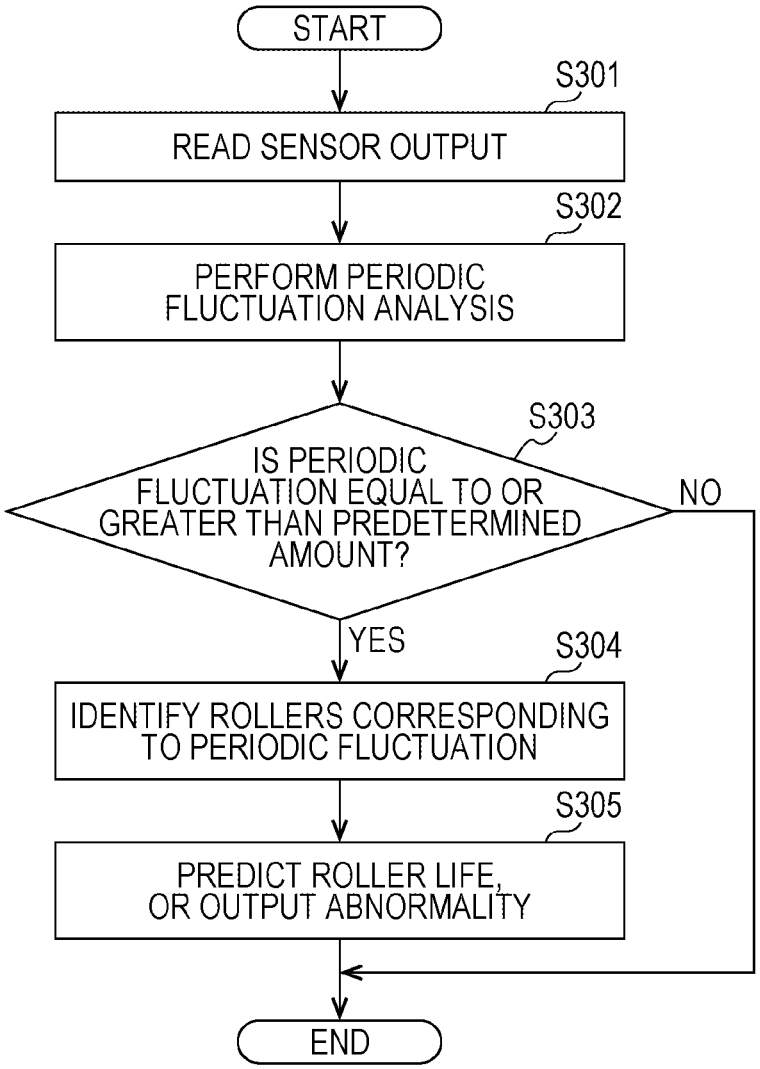
FIG. 20 is a flowchart showing a roller life predicting or abnormality determining process according to a fourth embodiment.

FIG. 20 is a flowchart showing a roller life predicting or abnormality determining process according to a fourth embodiment. The process shown in FIG. 20 is a process to be performed in parallel with the process shown in FIG. 15. This process may be performed at a time of sheet thickness measurement to be performed by the sheet thickness sensor 70, or may be performed during a process in which any paper sheet is not conveyed, such as the initial sequence time at which the power to the image forming apparatus 1 is turned on.

(Step S301)

The controller 11 reads an output of the displacement sensor 759. Through this output, a dozen or more pieces of measurement data per revolution are obtained during a period equivalent to at least several revolutions of the rollers.

(Step S302)

The controller 11 performs a frequency analysis in a process such as fast Fourier transform on the measurement data obtained in step S301, and thus, extracts periodic fluctuations. At this stage, data having a frequency much higher or much lower than the rotation period of the rollers may be excluded.

(Step S303)

The controller 11 determines whether a periodic fluctuation is equal to or greater than a predetermined amount. If there are no periodic fluctuations equal to or greater than the predetermined amount (NO), the process comes to an end (END). If there is a periodic fluctuation equal to or greater than the predetermined amount, on the other hand, the process moves onto step S304.

(Step S304)

The controller 11 compares the period during which there is a periodic fluctuation equal to or greater than the predetermined amount, with the rotation period calculated from the outer circumferences of the respective rollers (the rollers 71*a* and 71*b*) of the sheet thickness sensor 70 stored in the memory unit 12, and extracts the rollers with matching cycles.

(Step S305)

The controller 11 compares the current periodic fluctuation amount with the initial periodic fluctuation amount, and predicts the life that will last until the determination reference value is exceeded, in accordance with the increase rate or the increase amount of the periodic fluctuation amount. The controller 11 then causes the operation panel 15 or the like to display the result of the prediction. Alternatively, data is sent and output to a management server connected via a network. This determination is made for each roller. In this embodiment, the outer diameters of the roller 71*a* and the roller 71*b* have different values by at least such an amount that the cycles can be separated.

Here, the initial periodic fluctuation amount is the periodic fluctuation that was measured when the respective components were still in an unused state, and was stored into the memory unit 12. For example, when the user starts using a new image forming apparatus 1, or when a service person replaces parts, each part can be determined to be new at the timing of resetting of the history management data. Alternatively, if the fluctuation amount already exceeds a determination reference value, abnormality determination is performed, and the result is output and displayed on the operation panel 15 or is transmitted to the server.

As described above, in the fourth embodiment, the life of the sheet thickness sensor is predicted, or an abnormality is determined, from an output fluctuation corresponding to a rotation cycle of the conveyance roller pairs of the displacement sensor. In this manner, it is possible to avoid situations in which sheet thickness sensing cannot be accurately performed with a paper sheet sensing device, and correct measurement values cannot be obtained.

The principal components in the configurations of the image forming apparatus 1 including the paper sheet sensing device 18 (a media sensor) described above have been explained in the above description of the features of the embodiments. Therefore, embodiments are not limited to the above configurations, and various modifications may be made to the above embodiments within the scope of the claimed invention. Further, the configurations of general image forming apparatuses are not excluded.

For example, in FIGS. 3, 7, and others, the conveyance roller pair 186, which is the target for eliminating the influence on changes in the output of the displacement sensor 759, is disposed on the downstream side of the sheet thickness sensor 70. However, the conveyance roller pair 186 is not necessarily disposed at this position, and may be disposed on the upstream side, or may be disposed on both the upstream side and the downstream side. For example, there is a case where the conveyance roller pair on the downstream side is attached to the first attacher (the guide plate 182) to which the sheet thickness sensor 70 is attached.

Also, in the examples described above, the sheet thickness sensor 70 uses a roller (the upper roller 71*b*) as the reference member, but is not limited to this. The sheet thickness sensor 70 may measure a sheet thickness by bringing a member on a flat surface into contact with a surface of a paper sheet, and measuring the height of the member displaced due to the sheet thickness with a displacement sensor.

Further, in an example described above, the controller 11 has a learnt model, but embodiments are not limited to this. A server connected to the image forming apparatus 1 via a network may have a learnt model, so that the server can perform paper type determination. In this case, the image forming apparatus main body 10 transmits the data of measured sheet characteristics to the server. On the basis of this data, the server, which has received the data, performs paper type determination, and returns the determination results to the image forming apparatus. Further, in FIG. 1 and other drawings, the image forming apparatus 1 is connected to the optional sheet feeding unit 20, but may be a single image forming apparatus 1 without these options. For example, some other post-processing apparatus that performs post-processing on paper sheets subjected to image formation in the image forming apparatus main body 10 may be connected to the image forming apparatus 1.

Although embodiments of the present invention have been described and illustrated in detail, the disclosed embodiments are made for purposes of illustration and example only and not limitation. The scope of the present invention should be interpreted by terms of the appended claims.

What is claimed is:

1. A paper sheet sensing device comprising:

a sheet thickness sensor that includes a reference member and a displacement sensor, and senses a sheet thickness of a conveyed recording medium by bringing the reference member into contact with the recording medium and sensing a position of a height of the reference member with the displacement sensor, the position of the height having changed with the recording medium;

a first attacher to which the sheet thickness sensor is attached;

a conveyor that nips and conveys the recording medium, and is disposed adjacent to the sheet thickness sensor at a predetermined distance equal to or shorter than a length of the recording medium being conveyed, in a conveyance direction of the recording medium; and a displacement preventer that prevents a change in an output of the displacement sensor due to a shift of a relative position of the height of the reference member, depending on whether there is the recording medium nipped by the conveyor, when the sheet thickness sensor senses the sheet thickness, wherein the conveyor is attached to the first attacher, and a hole, a slit, or a thin part having a thinner plate thickness is formed as the displacement preventer in a region between an attachment position of the conveyor and an attachment position of the sheet thickness sensor in the first attacher, to make a rigidity in the region lower than in other regions.

2. The paper sheet sensing device according to claim 1, wherein the conveyor is a pair of conveyance rollers that nip and convey the recording medium, the sheet thickness sensor includes a roller pair formed with first and second rollers that nip and convey the recording medium, and a rotation axis of the second roller is supported by the first attacher in such a manner as to be movable in a thickness direction of the recording medium with respect to the first roller, and the second roller is the reference member.

3. The paper sheet sensing device according to claim 2, wherein the predetermined distance between the sheet thickness sensor and the conveyor is longer than a length of an outer circumference of the second roller.

4. A paper sheet conveying device comprising:

a sheet feed tray that stores a plurality of recording media;

a conveyor part that conveys a recording medium from the sheet feed tray into a conveyance path; and the paper sheet sensing device according to claim 1, the paper sheet sensing device sensing a sheet thickness of the recording medium conveyed into the conveyance path.

5. An image forming apparatus comprising:

the paper sheet conveying device according to claim 4; and an image former that forms an image on a recording medium conveyed by the paper sheet conveying device.

6. A paper sheet sensing device comprising:

a sheet thickness sensor that includes a reference member and a displacement sensor, and senses a sheet thickness of a conveyed recording medium by bringing the reference member into contact with the recording medium and sensing a position of a height of the reference member with the displacement sensor, the position of the height having changed with the recording medium;

a first attacher to which the sheet thickness sensor is attached;

a conveyor that nips and conveys the recording medium, and is disposed adjacent to the sheet thickness sensor at a predetermined distance equal to or shorter than a length of the recording medium being conveyed, in a conveyance direction of the recording medium; and a displacement preventer that prevents a change in an output of the displacement sensor due to a shift of a relative position of the height of the reference member, depending on whether there is the recording medium nipped by the conveyor, when the sheet thickness sensor senses the sheet thickness, wherein the conveyor is attached to the first attacher, when the recording medium passes through the conveyor, the first attacher is displaced, and the height of the reference member attached to the first attacher shifts, the displacement preventer is a hardware processor, and the hardware processor controls a period during which the sheet thickness sensor senses the sheet thickness, depending on timing at which the recording medium passes through the conveyor.

7. The paper sheet sensing device according to claim 6, wherein the hardware processor sets a period excluding the timing at which the recording medium passes through the conveyor as the period during which the sheet thickness sensor senses the sheet thickness.

8. A paper sheet sensing device comprising:

a sheet thickness sensor that includes a reference member and a displacement sensor, and senses a sheet thickness of a conveyed recording medium by bringing the reference member into contact with the recording medium and sensing a position of a height of the reference member with the displacement sensor, the position of the height having changed with the recording medium;

a first attacher to which the sheet thickness sensor is attached;

a conveyor that nips and conveys the recording medium, and is disposed adjacent to the sheet thickness sensor at a predetermined distance equal to or shorter than a length of the recording medium being conveyed, in a conveyance direction of the recording medium;

a displacement preventer that prevents a change in an output of the displacement sensor due to a shift of a relative position of the height of the reference member, depending on whether there is the recording medium nipped by the conveyor, when the sheet thickness sensor senses the sheet thickness; and a hardware processor that predicts a life duration of the sheet thickness sensor or determines an abnormality, from an output fluctuation of the displacement sensor depending on a rotation cycle of the conveyance roller pair, wherein the conveyor is a pair of conveyance rollers that nip and convey the recording medium, the sheet thickness sensor includes a roller pair formed with first and second rollers that nip and convey the recording medium, and a rotation axis of the second roller is supported by the first attacher in such a manner as to be movable in a thickness direction of the recording medium with respect to the first roller, and the second roller is the reference member.

9. The paper sheet sensing device according to claim 8, wherein the first and second rollers have different outer diameters, and the hardware processor distinguishes a roller at which the output fluctuation has occurred in accordance with a cycle of the output fluctuation, and performs life duration prediction or abnormality determination.

* * * * *